US011835044B2

(12) United States Patent
Sotojima et al.

(10) Patent No.: US 11,835,044 B2
(45) Date of Patent: Dec. 5, 2023

(54) ROTARY COMPRESSOR

(71) Applicant: DAIKIN INDUSTRIES, LTD., Osaka (JP)

(72) Inventors: Takazou Sotojima, Osaka (JP); Hirofumi Higashi, Osaka (JP); Kousuke Nishimura, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 467 days.

(21) Appl. No.: 16/637,585

(22) PCT Filed: Aug. 3, 2018

(86) PCT No.: PCT/JP2018/029263
§ 371 (c)(1),
(2) Date: Feb. 7, 2020

(87) PCT Pub. No.: WO2019/031412
PCT Pub. Date: Feb. 14, 2019

(65) Prior Publication Data

US 2020/0200173 A1 Jun. 25, 2020

(30) Foreign Application Priority Data

Aug. 9, 2017 (JP) ..... 2017-154217

(51) Int. Cl.
*F04C 23/02* (2006.01)
*F04C 15/00* (2006.01)
(Continued)

(52) U.S. Cl.
CPC ..... *F04C 23/02* (2013.01); *F04C 15/0065* (2013.01); *F04C 29/0057* (2013.01);
(Continued)

(58) Field of Classification Search
CPC .. F04C 23/02; F04C 15/0065; F04C 2240/40; F04C 2240/60; F04C 23/008; F04C 23/001; F04C 29/0057; F04C 18/322
See application file for complete search history.

(56) References Cited

U.S. PATENT DOCUMENTS 8,182,253 B2 5/2012 Hirayama
2003/0115900 A1* 6/2003 Matsumoto ..... F25B 1/10 62/81
(Continued)

FOREIGN PATENT DOCUMENTS

CN 1356476 A 7/2002
CN 101688535 A 3/2010
(Continued)

OTHER PUBLICATIONS

Raw Machine Translation of KR20150081137 (A); Lee Byeong Chul et al; A Rotary Compressor; Jul. 13, 2015.*
(Continued)

*Primary Examiner* — Charles G Freay
*Assistant Examiner* — Lilya Pekarskaya
(74) *Attorney, Agent, or Firm* — Global IP Counselors, LLP

(57) ABSTRACT

A rotary compressor includes a first cylinder, a first piston and a drive shaft. The drive shaft includes a first eccentric portion, a first shaft portion rotatably supported by a first bearing, and a first coupling portion coupling the first shaft portion with the first eccentric portion. The first piston is fitted to the first eccentric portion. The first shaft portion has a cylindrical shape coaxial with the rotational center axis. $R_{e1}-e_1<R_1$. $R_{e1}$ is a radius of the first eccentric portion. $R_1$ is a radius of the first shaft portion. $e_1$ is an eccentricity of the first eccentric portion. An outer surface of the first coupling portion does not extend radially out of an outer surface of the first eccentric portion. The first coupling
(Continued)

portion includes a reinforcement portion with an outer surface positioned radially outside an outer surface of the first shaft portion.

7 Claims, 13 Drawing Sheets

(51) Int. Cl.
*F04C 29/00* (2006.01)
*F04C 23/00* (2006.01)

(52) U.S. Cl.
CPC ..... *F04C 23/008* (2013.01); *F04C 2240/40* (2013.01); *F04C 2240/60* (2013.01)

(56) References Cited

U.S. PATENT DOCUMENTS

2006/0153723 A1* 7/2006 Kurita ..... F04C 18/3562 418/29
2010/0147013 A1* 6/2010 Hirayama ..... F04C 23/008 62/401
2010/0296959 A1 11/2010 Shimizu et al.
2011/0179822 A1* 7/2011 Sotojima ..... F04C 28/02 62/510
2017/0074269 A1* 3/2017 Katayama ..... F04C 29/068

FOREIGN PATENT DOCUMENTS

| | | | |
|---|---|---|---|
| EP | 2 770 212 | A1 | 8/2014 |
| JP | 61-108887 | A | 5/1986 |
| JP | 2002-138978 | A | 5/2002 |
| JP | 2004-100608 | A | 4/2004 |
| JP | 2012-127198 | A | 7/2012 |
| JP | 2012-149545 | A | 8/2012 |
| JP | 2014-173546 | A | 9/2014 |
| KR | 20150081137 | * | 7/2015 |
| WO | 2013/057946 | A1 | 4/2013 |

OTHER PUBLICATIONS

European Search Report of corresponding EP Application No. 18 84 5099.3 dated Nov. 6, 2020.
International Search Report of corresponding PCT Application No. PCT/JP2018/029263 dated Oct. 23, 2018.
International Preliminary Report of corresponding PCT Application No. PCT/JP2018/029263 dated Feb. 20, 2020.

* cited by examiner

ROTARY COMPRESSOR

CROSS-REFERENCE TO RELATED APPLICATIONS

This U.S. National stage application claims priority under 35 U.S.C. § 119(a) to Japanese Patent Application No. 2017-154217, filed in Japan on Aug. 9, 2017, the entire contents of which are hereby incorporated herein by reference.

BACKGROUND

Field of the Invention

The present invention relates to a rotary compressor that sucks and compresses a fluid.

BACKGROUND INFORMATION

There has been known a rotary compressor for compressing a refrigerant by eccentrically rotating a piston inside a cylinder. Some of such rotary compressors are intended to increase the capacity without increasing the sliding loss between the cylinder and the piston by increasing only the eccentricity without increasing; the diameter of the eccentric portion of the drive shaft and the cylinder height (see, for example, Japanese Unexamined Patent Publication No. S61-108887.)

In the above rotary compressor, when the eccentricity is increased while maintaining the diameter of the eccentric portion of the drive shaft, the outer surface of the eccentric portion on the side opposite to the eccentric side is positioned on the eccentric side of the outer surface of the non-eccentric shaft portion (the main shaft portion, the auxiliary shaft portion) on the side opposite to the eccentric side, i.e., the outer surface of the drive shaft on the side opposite to the eccentric side is recessed toward the eccentric side at the eccentric portion. With such a configuration, when the piston is assembled to the eccentric portion while being moved from the main shaft portion or auxiliary shaft portion side in the axial direction of the drive shaft, the piston is in contact with the axial end surface of the eccentric portion and thus is not moved further in the axial direction, so that the piston cannot be attached to the eccentric portion.

Hence, in the rotary compressor described in the Japanese Unexamined Patent Publication No. S61-108887, the outer surface of a part adjacent to the eccentric portion in the main shaft portion of the drive shaft on the side opposite to the eccentric side is cut out in accordance with the outer surface of the eccentric portion on the side opposite to the eccentric side to secure a space for shifting the piston to the position where the piston can be fitted to the eccentric portion when the piston is assembled to the eccentric portion. With such a configuration, when the piston is assembled to the eccentric portion while being moved from the main shaft portion side in the axial direction of the drive shaft, the piston can be shifted in the radial direction of the drive shaft to the position where the piston can be fitted to the eccentric portion (position where the inner peripheral surface of the piston is positioned outside the outer peripheral surface of the eccentric portion in the radial direction of the drive shaft) using the space secured by a notch formed in the main shaft portion. In the above rotary compressor, the piston can be assembled to the eccentric portion in this manner.

SUMMARY

However, with the configuration of the above rotary compressor, in which the outer surface a part adjacent to the eccentric portion in the main shaft portion on the side opposite to the eccentric side is cut out so that the piston can be fitted to the eccentric portion, the diameter of the drive shaft around the eccentric portion becomes small, resulting in a problem the warpage of the drive shaft becomes large.

In view of the foregoing, it is therefore an object of the present invention to substantially prevent warpage of the drive shaft in the rotary compressor with increased eccentricity of the eccentric portion of the drive shaft.

In the first aspect of the present disclosure, a rotary compressor includes: a first cylinder (35), a first piston (45) that has a cylindrical shape and revolves along the inner wall surface of the first cylinder (35) and forms a first compression chamber (39) for compressing a fluid between the first piston (45) and the inner wall surface of the first cylinder (35); a drive shaft (70) that is rotatable and includes a first eccentric portion (76) that is eccentric in the first direction with respect to the rotational center axis (70*a*) and to which the first piston (45) is fitted. The drive shaft (70) includes: a first shaft portion (74) that is rotatably supported by a first bearing (27) formed on an end plate (25) for closing one end face of the first cylinder (35) and has a cylindrical shape coaxial with the rotational center axis (70*a*) of the drive shaft (70); and a first coupling portion (90) that couples the first shaft portion (74) with the eccentric portion (76) and configured to satisfy $R_{e1}-e_1<R_1$, wherein $R_{e1}$ is the radius of the first eccentric portion (76), $R_1$ is the radius of the first shaft portion (74), and $c_1$ is the eccentricity of the first eccentric portion (76). The first coupling portion (90) is formed such that its outer surface does not extend out of the outer surface of the first eccentric portion (76) in the radial direction of the drive shaft (70) and includes a reinforcement portion (92) with its outer surface positioned outside the outer surface of the first shaft, portion (74) in the radial direction of the drive shaft (70).

In the second aspect of the present disclosure, a rotary compressor includes: a first cylinder (35) and a second cylinder (30); a first piston (45) that has a cylindrical shape and revolves along an inner wall surface of the first cylinder (35) and forms a first compression chamber (39) for compressing a fluid between the first piston (45) and the inner wall surface of the first cylinder (35); a second piston (40) that has a cylindrical shape and revolves along the inner wall surface of the second cylinder (30) and forms a second compression chamber (34) for compressing a fluid between the second piston (40) and the inner wall surface of the second cylinder (30); and a drive shaft (70) that is rotatable and includes: a first eccentric portion (76) that is eccentric in the first direction with respect to the rotational center axis (70*a*) and to which the first piston (45) is fitted; a second eccentric portion (75) that is eccentric in the second direction opposite to the first direction with respect to the rotational center axis (70*a*) and to which the second piston (40) is fitted; and an intermediate coupling portion (80) that couples the first eccentric portion (76) with the second eccentric portion (75). The drive shaft (70) further includes: a first shaft portion (74) that is rotatably supported by a first bearing (27) formed on an end plate (25) for closing one end face of the first cylinder (35) and has a cylindrical shape coaxial with the rotational center axis (70*a*) of the drive shaft (70); and a first coupling portion (90) that couples the first shaft portion (74) with the eccentric portion (76) and configured to satisfy $R_{e1}-e_1<R_1$, wherein $R_{e1}$ is the radius of the first eccentric portion (76), $R_1$ is the radius of the first shaft portion (74), and $e_1$ is the eccentricity of the first eccentric portion (76). The intermediate coupling portion (80) includes a first intermediate reinforcement portion (82) that is formed in an area on the first direction side, disposed adjacent to the first eccentric portion (76), and has an outer surface positioned inside the outer surface of the first eccentric portion (76) and positioned outside the outer surface of the second eccentric portion (75) in the radial direction of the drive shaft (70).

In the first aspect, when the drive shaft (70) is driven to rotate by the electric motor (10), the first piston (45) fitted to the first eccentric portion (76) of the drive shaft (70) revolves in the first cylinder (35), and the volumetric capacity of the first compression chamber (39) partitioned by the first cylinder (35) and the first piston (45) changes, thereby compressing the fluid.

In the second aspect, when the drive shaft (70) is driven to rotate by the electric motor (10), the first piston (45) fitted to the first eccentric portion (76) of the drive shaft (70) revolves in the first cylinder (35), and the volumetric capacity of the first compression chamber (39) partitioned by the first cylinder (35) and the first piston (45) changes, thereby compressing the fluid. Further, the second piston (40) fitted to the second eccentric portion (75) of the drive shaft (70) revolves in the second cylinder (30), and the volumetric capacity of the second compression chamber (34) partitioned by the second cylinder (30) and the second piston (40) changes, thereby compressing the fluid.

The rotary compressor (1) is configured such that the length obtained by subtracting the eccentricity $e_1$ of the first eccentric portion (76) from the radius $R_{e1}$ of the first eccentric portion (76), i.e., the length from the rotational center axis (70*a*) of the drive shaft (70) to the outer surface of the first eccentric portion (76) in the second direction (direction opposite to the eccentric direction) (the minimum length from the rotational center axis (70*a*) of the drive shaft (70) to the outer surface of the first eccentric portion (76)) becomes smaller than the radius $R_1$ of the first shaft portion (74) That is, in the rotary compressor (1), the first eccentric portion (76) is configured such that its outer surface on the second direction side (the side opposite to the eccentric side) is recessed in the first direction (toward the eccentric side) with respect to the outer surface of the second direction side (the side opposite to the eccentric side) of the first shaft portion (74), thereby increasing only the eccentricity without increasing the diameter of the first eccentric portion (76).

With such a configuration, in which the outer surface of the drive shaft (70) on the second direction side is recessed toward the eccentric side at the first eccentric portion (76), when the first piston (45) is assembled to the first eccentric portion (76) while being moved from the first shaft portion (74) side in the axial direction of the drive shaft (70), the first piston (45) is in contact with the axial end surface of the first eccentric portion (76) and thus is not moved further in the axial direction, so that the first piston (45) cannot be attached to the first eccentric portion (76).

Thus, the rotary compressor (1) is provided with the first coupling portion (76) formed between the first eccentric portion (76) and the first shaft portion (74) so that the outer surface does not extend out of the outer surface of the first eccentric portion (76) in the radial direction of the drive shaft (70). That is, the first coupling portion (90) with its outer surface on the second direction side recessed in the first direction with respect to the outer surface of the first shaft portion (74) on the second direction side as in the first eccentric portion (76) is provided between the first eccentric portion (76) and the first shaft portion (74) in the drive shaft (70). By providing such a first coupling portion (90), a space for shifting the first piston (45) to a position at which the first piston (45) can be fitted to the first eccentric portion (76) when the first piston (45) is assembled to the first eccentric portion (76) is secured. That is, in the rotary compressor (1), when the first position (45) is moved from the first shaft portion (74) side in the axial direction of the drive shaft (70) to be fitted to the first eccentric portion (76), the first piston (45) can be moved on the outer periphery of the first coupling portion (90) in the radial direction of the drive shaft (70) to the position where the first piston (45) can be fitted to the first eccentric portion (76) (position where the inner peripheral surface of the first piston (45) is positioned outside the outer peripheral surface of the first eccentric portion (76) in the radial direction of the drive shaft (70)). The first piston (45) is shifted on the outer periphery of the first coupling portion (90) in this manner and is then again moved in the axial direction of the drive shaft (70), so that the first piston (45) can be attached to the first eccentric portion (76).

When, in the first coupling portion (90) with its outer surface on the second direction side being recessed in the first direction with respect to the outer surface of the first shaft portion (74) on the second direction side, the outer surface on the first direction side is aligned with the outer surface of the first shaft portion (74) on the first direction side, the first coupling portion (90) becomes thinner than the first shaft portion (74). Accordingly, the drive shaft (70) is necked down at the first coupling portion (90) and is easily warped.

Hence, in the first aspect, the first coupling portion (90) is provided with the reinforcement portion (92) with its outside surface positioned outside the outer surface of the first shaft portion (74) in the radial direction of the drive shaft (70) The first coupling portion (90) is formed to be thick by providing such a reinforcement portion (92), so that warpage of the drive shaft (70) can be substantially prevented.

On the other hand, in the second aspect, a first intermediate reinforcement portion (82) with its outer surface positioned inside the outer surface of the first eccentric portion (76) and positioned outside the outer surface of the second eccentric portion (75) is provided adjacent to the first eccentric portion (76) in an area of the intermediate coupling portion (80) coupling the first eccentric portion (76) with the second eccentric portion (75) on the first direction side. By providing such a first intermediate reinforcement portion (82), a part of the intermediate coupling portion (80) on the first eccentric portion (76) side between the first eccentric portion (76) and the second eccentric portion (75) that eccentrically rotate is formed to be thick.

In a third aspect of the present disclosure according to the first aspect, the rotary compressor further include: a second cylinder (30); and a second piston (40) that has a cylindrical shape and revolves along the inner wall surface of the second cylinder (30) and forms a second compression chamber (34) for compressing a fluid between the second piston (40) and the inner wall surface of the second cylinder (30). The drive shaft (70) further includes: a second eccentric portion (75) that is provided on a side opposite to the first coupling portion (90) of the first eccentric portion (76) in the axial direction and is eccentric in the second direction opposite to the first direction with respect to the rotational center axis (70*a*) and to which the second piston (40) is fitted; and an intermediate coupling portion (80) that couples the first eccentric portion (76) with the second eccentric portion (75). The intermediate coupling portion (80) includes a first intermediate reinforcement portion (82) that is formed in an area on the first direction side, disposed adjacent to the first eccentric portion (76), and has an outer surface positioned inside the outer surface of the first eccentric portion (76) and positioned outside the outer surface of the second eccentric portion (75) in the radial direction of the drive shaft (70).

In the third aspect, a first intermediate reinforcement portion (82) with its outer surface positioned inside the outer surface of the first eccentric portion (76) and positioned outside the outer surface of the second eccentric portion (75) is provided adjacent to the first eccentric portion (76) in an area of the intermediate coupling portion (80) coupling the first eccentric portion (76) with the second eccentric portion (75) on the first direction side. By providing such a first intermediate reinforcement portion (82), a part of the intermediate coupling portion (80) on the first eccentric portion (76) side between the first eccentric portion (76) and the second eccentric portion (75) that eccentrically rotate is formed to be thick.

In the fourth aspect of the present disclosure, according to the second and third aspects, the intermediate coupling portion (80) includes a second intermediate reinforcement portion (83) that is formed in an area on the second direction side, disposed adjacent to the second eccentric portion (75), and has an outer surface positioned inside the outer surface of the second eccentric portion (75) and positioned outside the outer surface of the first eccentric portion (76) in the radial direction of the drive shaft (70).

In the fourth aspect, a second intermediate reinforcement portion (83) with its outer surface positioned inside the outer surface of the second eccentric portion (76) and positioned outside the outer surface of the first eccentric portion (76) is provided adjacent to the second eccentric portion (75) in an area of the intermediate coupling portion (80) coupling the first eccentric portion (76) with the second eccentric portion (75) on the second direction side. By providing such a second intermediate reinforcement portion (82), a part of the intermediate coupling portion (80) on the second eccentric portion (75) side between the first eccentric portion (76) and the second eccentric portion (75) that eccentrically rotate is formed to be thick.

In the fifth aspect of the present disclosure according to the fourth aspect, in the intermediate coupling portion (80), the first intermediate reinforcement portion (82) and the second intermediate reinforcement portion (83) overlap with each other in an axial direction of the drive shaft (70), and at least a part (86) of the portion where the first intermediate reinforcement portion (82) and the second intermediate reinforcement portion (83) overlap with each other in the intermediate coupling portion (80) has a cylindrical shape coaxial with the rotational center axis of the drive shaft (70).

In the fifth aspect, in the intermediate coupling portion (80), the first intermediate reinforcement portion (82) and the second intermediate reinforcement portion (83) overlap with each other in the axial direction of the drive shaft (70), and a part (86) of the overlapping portion has a cylindrical shape coaxial with the rotational center axis (70*a*) of the drive shaft (70). In this manner, a part (86) of a portion where the first intermediate reinforcement portion (82) and the second intermediate reinforcement portion (83) overlap with each other in a middle area of the intermediate coupling portion (80) in the axial direction has a cylindrical shape.

In the sixth aspect of the present disclosure according to any one of the second to fifth aspects, the drive shaft (70) further includes a second shaft portion (72) that continuously extends from the side of the second eccentric portion (75) opposite to the intermediate coupling portion (80) in the axial direction, to which an electric motor (10) that drives the drive shaft (70) to rotate is coupled, that is rotationally supported by the second bearing (22) thrilled on the end plate (20) for closing one end face of the second cylinder (30), and that has a cylindrical shape coaxial with the rotational center axis (70*a*) of the drive shaft (70), and the first shaft portion (74) has a smaller diameter than the second shaft portion (72).

In a multi-cylinder rotary compressor including a plurality of eccentric portions, when eccentric portions with increased eccentricity without increasing the diameters are provided on a side of the main shaft portion coupled with an electric motor and has a large diameter than an auxiliary shaft portion in a drive shaft, a piston cannot be configured to be fitted to the eccentric portions without notching the outer surface of a portion adjacent to the eccentric portions of the main shaft portion on a side opposite to the eccentric side as in a conventional rotary compressor. Although the main shaft portion coupled with an electric motor in the drive shaft is required to have large strength, the diameter of a part of the main shaft portion adjacent to the eccentric portions becomes small with such a configuration, and warpage of the drive shaft may become large.

In contrast, in the sixth aspect, the first eccentric portion (76) with increased eccentricity without increasing the diameter is provided not on the second shaft portion (72) side having a larger diameter, coupled to the electric motor (10) of the drive shaft (70), but on the first shaft portion (74) side having a smaller diameter than the second shaft portion (72). Thus, in order to configure the first piston (45) to be fitted to the first eccentric portion (76), the first coupling portion (90) with its outer surface on the second direction side being recessed in the first direction is coupled with not the second shaft portion (72) having a large diameter, but the first shaft portion (74) having a small diameter. Accordingly, the diameter of the second shaft portion (72) that is coupled with the electric motor (10) and is thus required to have large strength in the drive shaft (70) is not reduced, thereby causing no reduction in strength.

In the seventh aspect of the present disclosure according to the sixth embodiment, the rotary compressor further includes an intermediate end plate (50) that has a middle hole (51) for allowing the drive shaft (70) to pass therethrough, blocks the other ends of the first cylinder (35) and the second cylinder (30) between the first cylinder (35) and the second cylinder (30), and is in sliding contact with the other ends of the first piston (45) and the second piston (40), and the first eccentric portion (76) has a smaller diameter than the second eccentric portion (75).

In a seventh aspect, the first eccentric portion (76) has a smaller diameter than the second eccentric portion (75). With this configuration, the intermediate end plate (50) can be easily attached between the first cylinder (35) and the second cylinder (30) by attaching the intermediate end plate (50) between the first cylinder (35) and the second cylinder (30) from the first shaft portion (74) side of the drive shaft (70) through the outer periphery of the first eccentric portion (76) having a smaller diameter.

In the eighth aspect of the present disclosure according to the sixth or seventh aspect, the drive shaft (70) is configured to satisfy $Re_2-e_2 \geq R_2$, wherein $Re_2$, $R_2$ is the radius of the second shaft portion (72), and $e_2$ is the eccentricity of the second eccentric portion (75).

In the eighth aspect, the rotary compressor is configured such that the length obtained by subtracting the eccentricity $e_2$ of the second eccentric portion (75) from the radius $R_{e2}$ of the second eccentric portion (75), i.e., the length from the rotational center axis (70*a*) of the drive shaft (70) to the outer surface of the second eccentric portion (75) in the first direction (direction opposite to the eccentric direction) (the minimum length from the rotational center axis (70*a*) of the drive shaft (70) to the outer surface of the second eccentric portion (75)) becomes the radius $R_2$ of the second shaft portion (72) or more. That is, in the rotary compressor (1), the first eccentric portion (76) is configured such that its outer surface on the second direction side (the side opposite to the eccentric side) is recessed in the first direction (toward the eccentric side) with respect to the outer surface of the second direction side (the side opposite to the eccentric side) of the first shaft portion (74), thereby increasing only the eccentricity without increasing the diameter of the first eccentric portion (76). The second eccentric portion (75) is formed such that its outer surface on the side (first direction side) opposite to the eccentric side is not recessed toward the eccentric side (second direction side) with respect to the outer surface of the second shaft portion (72) on the side opposite to the eccentric side.

With such a configuration, in which the outer surface of the drive shaft (70) on the first direction side is recessed toward the eccentric side at the second eccentric portion (75), when the second piston (40) is assembled to the second eccentric portion (75) while being moved from the second shaft portion (72) side in the axial direction of the drive shaft (70), the second piston (40) is in contact with the axial end surface of the second eccentric portion (75) and thus is not moved further in the axial direction, so that the second piston (40) cannot be attached to the second eccentric portion (75). In such a case, as in the first piston (45), the second piston (40) is also required to be assembled to the second eccentric portion (75) while being moved from the first shaft portion (74) side on which the first coupling portion (90) of the drive shaft (70) is formed in the axial direction. Therefore, the ease of assembling is inferior.

However, the rotary compressor (1) is configured such that its outer surface of the drive shaft (70) is not recessed toward the eccentric side at the second eccentric portion (75) ($Re_2-e_2 \geq R_2$). Therefore, when the first and second pistons (45, 40) are assembled to the first and second eccentric portions (76, 75), respectively, the first piston (45) may allow the drive shaft (70) to be inserted from the first shaft portion (74) side, and the second piston (40) may allow the drive shaft (70) to be inserted from the second shaft portion (72).

In the first and second aspects, the eccentricity is only increased without increasing the diameter of the first eccentric portion (76). Accordingly, the capacity can be increased without increasing sliding loss of the first piston (45) on the first cylinder (35).

In the first and second aspects, the first coupling portion (90) is provided between the first eccentric portion (76) and the first shaft portion (74) such that its outer surface is not extended out of the outer surface of the first eccentric portion (76) in the radial direction of the drive shaft (70). Accordingly, the first piston (45) can be assembled to the first eccentric portion (76) even when the eccentricity is only increased without increasing the diameter of the first eccentric portion (76).

In the first aspect, a reinforcement portion (92) with its outer surface positioned outside the outer surface of the first shaft portion (74) in the radial direction of the drive shaft (70) is provided in the first coupling portion (90). Accordingly, since the first coupling portion (90) is formed to be thick by the reinforcement portion (92), the warpage of the drive shaft (70) can be substantially prevented even when the first coupling portion (90) is famed such that its outer surface on the second direction side is recessed in the first direction with respect to the outer surface of the first shaft portion (74) on the second direction side.

In the second and third aspects, a first intermediate reinforcement portion (82) with its outer surface positioned inside the outer surface of the first eccentric portion (76) and positioned outside the outer surface of the second eccentric portion (75) is provided adjacent to the first eccentric portion (76) in an area of the intermediate coupling portion (80) coupling the first eccentric portion (76) with the second eccentric portion (75) on the first direction side. By providing such a first intermediate reinforcement portion (82), a part of the intermediate coupling portion (80) on the first eccentric portion (76) side between the first eccentric portion (76) and the second eccentric portion (75) that eccentrically rotate can be formed to be thick. Accordingly, the warpage of the drive shaft can be substantially prevented.

In the fourth aspect, a second intermediate reinforcement portion (83) with its outer surface positioned inside the outer surface of the second eccentric portion (75) and positioned outside the outer surface of the first eccentric portion (76) is provided adjacent to the second eccentric portion (75) in an area of the intermediate coupling portion (80) coupling the first eccentric portion (76) with the second eccentric portion (75) on the second direction side. By providing such a second intermediate reinforcement portion (83), a part of the intermediate coupling portion (80) on the second eccentric portion (75) side between the first eccentric portion (76) and the second eccentric portion (75) that eccentrically rotate can be formed to be thick. Accordingly, the warpage of the drive shaft can be substantially further prevented.

In the fifth aspect, in the intermediate coupling portion (80), the first intermediate reinforcement portion (82) and the second intermediate reinforcement portion (83) overlap with each other in the axial direction of the drive shaft (70), and a part (86) of the overlapping portion has a cylindrical shape coaxial with the rotational center axis (70*a*) of the drive shaft (70). By forming a part (86) of a portion where the first intermediate reinforcement portion (82) and the second intermediate reinforcement portion (83) overlap with each other in a middle area of the intermediate coupling portion (80) in the axial direction into a cylindrical shape, the middle part of the intermediate coupling portion (80) in the axial direction can be formed to be thick. Accordingly, the warpage of the drive shaft can be substantially further prevented.

In the sixth aspect, the first eccentric portion (76) with increased eccentricity without increasing the diameter is provided not on the second shaft portion (72) side having a larger diameter, coupled to the electric motor (10) of the drive shaft (70), but on the first shaft portion (74) side having a smaller diameter than the second shaft portion (72). Thus, in order to configure the first piston (45) to be fitted to the first eccentric portion (76), the first coupling portion (90) with its outer surface on the second direction side being recessed in the first direction is coupled with not the second shaft portion (72) having a large diameter, but the first shaft portion (74) having a small diameter. Accordingly, an increase in warpage of the drive shaft (70) can be substantially prevented without decreasing the strength of the second shaft portion (72) that is coupled with the electric motor (10) and is required to have large strength in the drive shaft (70).

In a seventh aspect, the first eccentric portion (76) has a smaller diameter than the second eccentric portion (75). With this configuration, the intermediate end plate (50) can be easily attached between the first cylinder (35) and the second cylinder (30) without increasing the diameter of the middle hole (51) of the intermediate end plate (50) by attaching the intermediate end plate (50) between the first cylinder (35) and the second cylinder (30) from the first shaft portion (74) side of the drive shaft (70) through the outer periphery of the first eccentric portion (76) having a smaller diameter.

In the eighth aspect, the rotary compressor is configured such that its outer surface of the drive shaft (70) is not recessed toward the eccentric side at the second eccentric portion (75) ($R_{e2}-e_2 \geq R_2$). Therefore, when the first and second pistons (45, 40) are assembled to the first and second eccentric portions (76, 75), respectively, the first piston (45) allows the drive shaft (70) to be inserted from the first shaft portion (74) side, and the second piston (40) allows the drive shaft (70) to be inserted from the second shaft portion (72). Accordingly, the second piston (40) can be assembled directly to the second eccentric portion (75) without bringing the second piston (40) to across the first eccentric portion (76). Accordingly, the eighth aspect can improve the ease of assembly.

DETAILED DESCRIPTION OF EMBODIMENT(S)

Embodiments of the present invention will be described in detail with reference to the drawings. Note that the following embodiments and variations are merely beneficial examples in nature, and are not intended to limit the scope, applications, or use of the present invention.

First Embodiment

A first embodiment of the present invention will now be described.

General Configuration of Compressor

Figure 1:
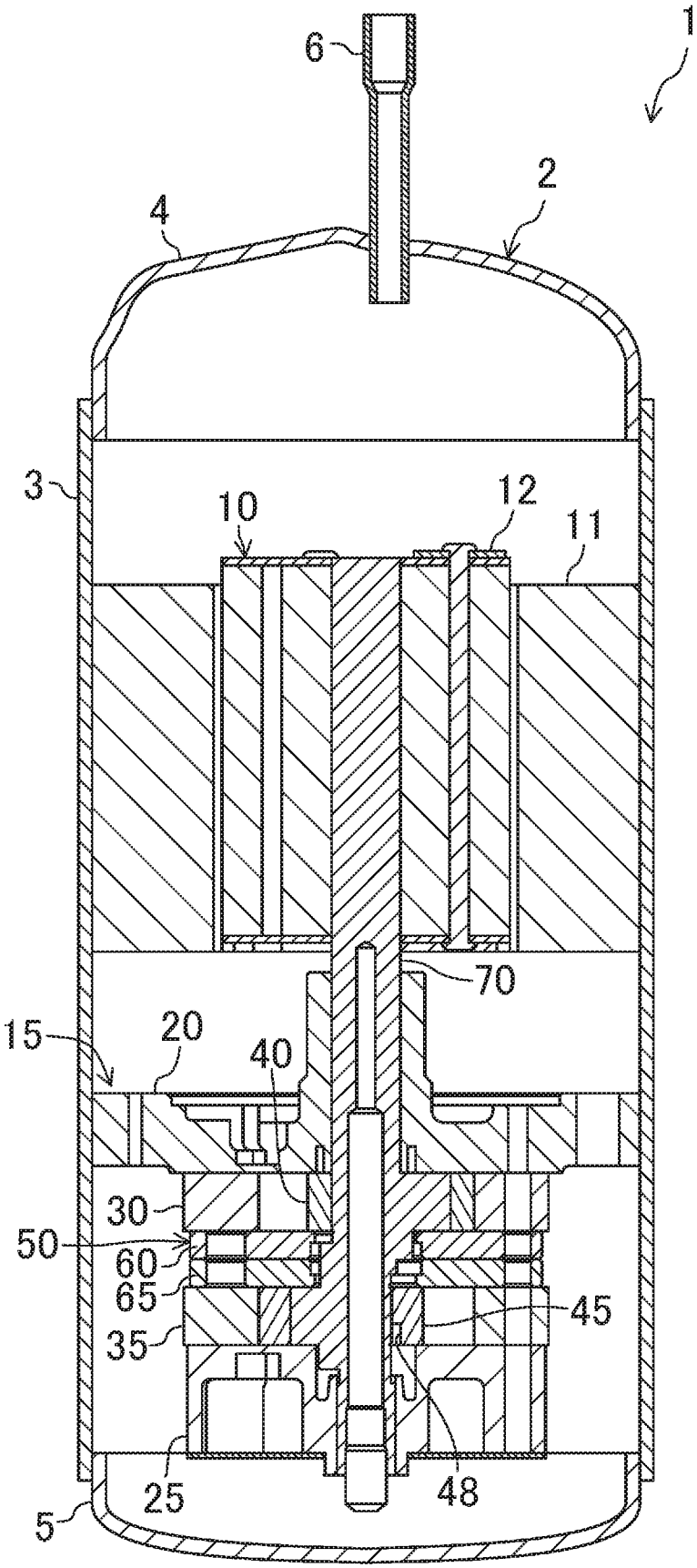
FIG. 1 is a vertical cross-sectional view illustrating a rotary compressor.

As shown in FIG. 1, the compressor according to the present embodiment is a hermetic rotary compressor (1). The rotary compressor (1) includes a compression mechanism (15) and an electric motor (10) housed in a casing (2). The rotary compressor (1) is provided to a refrigerant circuit performing a vapor compression refrigeration cycle and sucks and compresses a refrigerant evaporated in an evaporator.

The casing (2) is a hermetically-sealed, standing, cylindrical container. The casing (2) includes a cylindrical barrel (3) and a pair of end plates (4, 5) for blocking ends of the barrel (3). A suction pipe (not shown) is attached to a lower part of the barrel (3). A discharge pipe (6) is attached to the upper end plate (4).

The electric motor (10) is disposed at an upper part of an internal space of the casing (2). The electric motor (10) includes a stator (II) and a rotor (12). The stator (11) is fixed to the barrel (3) of the casing (2). The rotor (12) is attached to a drive shalt (70) of the compression mechanism (15) to be mentioned below.

The compression mechanism (15) is an swinging-piston, rotary fluid machinery. The compression mechanism (15) is disposed below the electric motor (10) in the internal space of the casing (2).

Compression Mechanism

Figure 2:
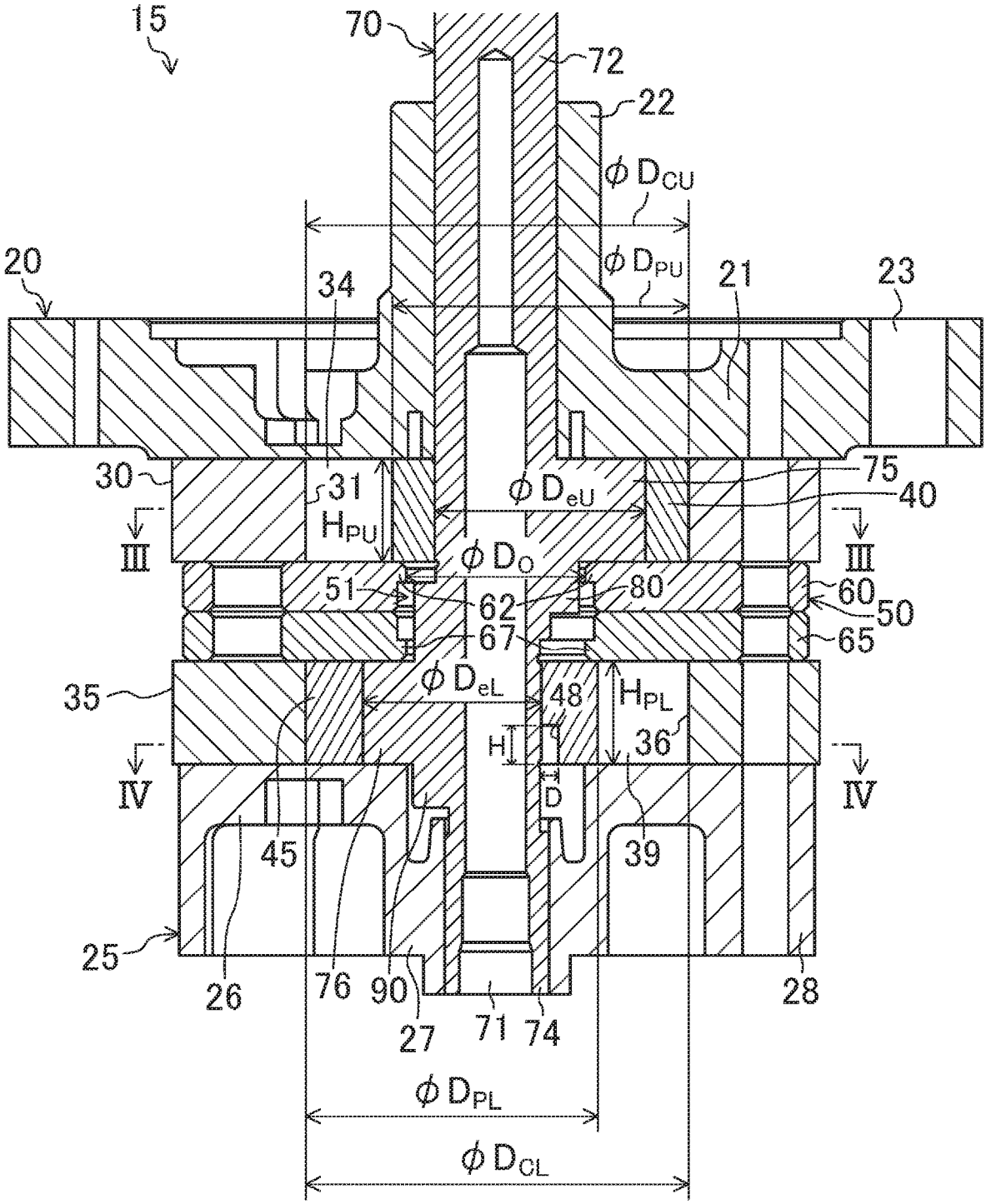
FIG. 2 is a vertical cross-sectional view illustrating a compression mechanism in the rotary compressor.

As shown in FIG. 2, the compression mechanism (15) is a two-cylinder rotary fluid machinery. The compression mechanism (15) includes a front head (20), a rear head (25), and a drive shaft (70). The compression mechanism (15) includes two cylinders (30, 35), two pistons (40, 45), and two blades (41, 46). The cylinder (30) includes two bushes (42) to be paired, and the cylinder (35) includes two bushes (47) to be paired. The compression mechanism (15) includes an intermediate plate (50).

In the compression mechanism (15), the rear head (25), the lower cylinder (first cylinder) (35), the intermediate plate (50), the upper cylinder (second cylinder) (30), and the front head (20) are disposed to overlap with each other in this order from the bottom to the top. The rear head (25), the lower cylinder (35), the intermediate plate (50), the upper cylinder (30), and the front head (20) are fixed to each other with bolts (not shown). In the compression mechanism (15), the front head (20) is fixed to the barrel (3) of the casing (2).

(First Cylinder, Second Cylinder)

Figure 3:
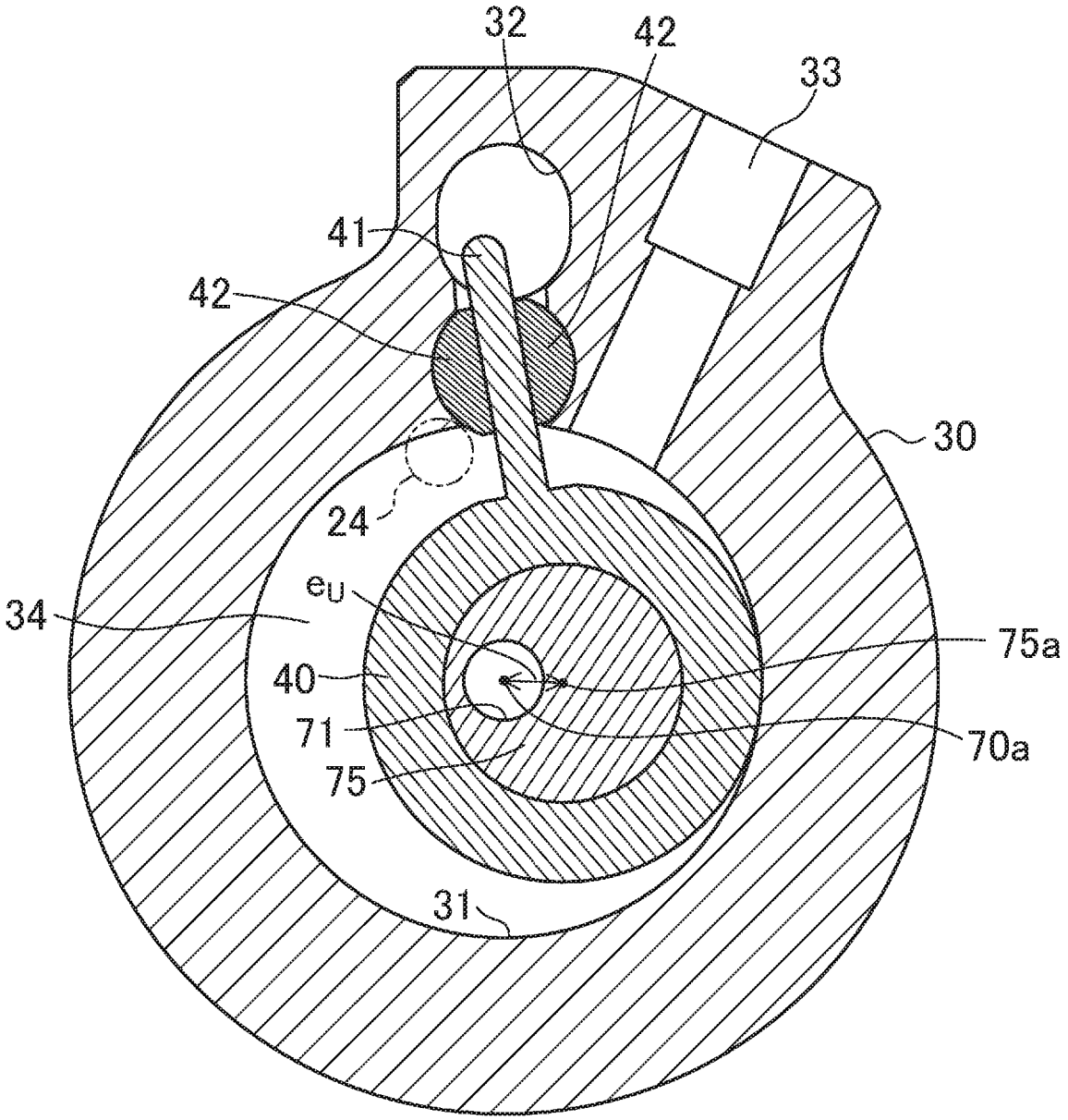
FIG. 3 is a transverse cross-sectional view illustrating the cross section of the compression mechanism taken along line III-III in FIG. 2.
Figure 4:
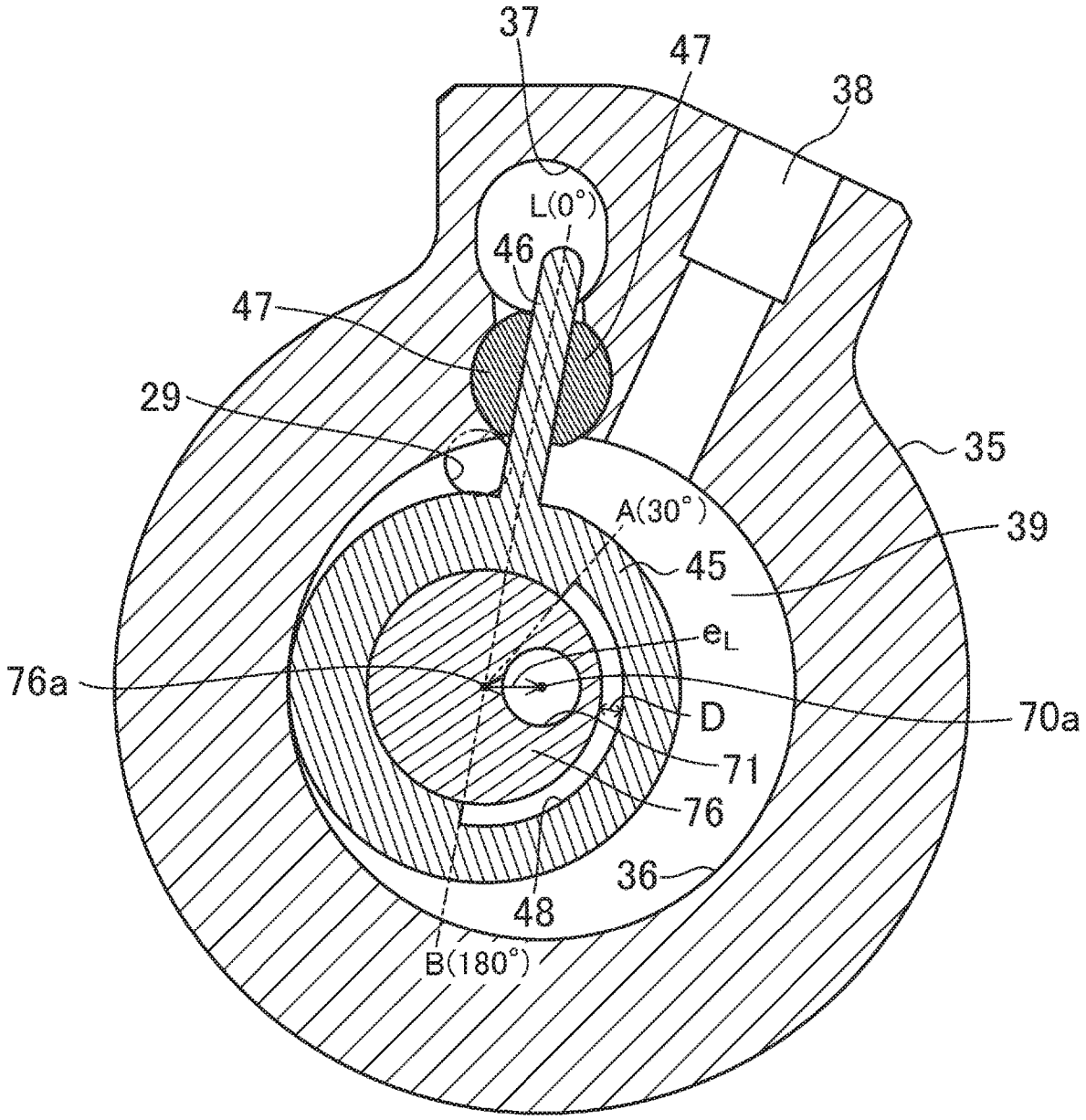
FIG. 4 is a transverse cross-sectional view illustrating the cross section of the compression mechanism taken along line IV-IV in FIG. 2.

As shown in FIGS. 2 to 4, each of the cylinders (30, 35) is a thick disc-shaped member. The lower cylinder (35) forms a first cylinder, and the upper cylinder (30) forms a second cylinder. A cylinder bore (31), a blade housing hole (32), and a suction port (33) are formed in the cylinder (30), and the cylinder bore (36), a blade housing hole (37), and the suction port (38) are formed in the cylinder (35). The upper cylinder (30) has the same thickness as the lower cylinder (35). Although not shown in FIGS. 3 and 4, a plurality of through holes penetrating the cylinders (30, 35) in the thickness direction, such as through holes for allowing bolts for assembling the compression mechanism (15) to be inserted therein and to pass therethrough are formed in the cylinders (30, 35).

The cylinder bores (31, 36) are circular holes for allowing the cylinders (30, 35) to pass therethrough in the thickness direction and are formed in the middle of the cylinders (30, 35), respectively. The cylinder bore 31 in the upper cylinder 30 houses the upper piston (second piston) (40). The cylinder bore 36 in the lower cylinder 35 houses the lower piston (first piston) (45). The inner diameter $\varphi D_{CU}$ of the cylinder bore (31) in the upper cylinder (30) is the same as the inner diameter $\varphi D_{CL}$ of the cylinder bore (36) in the lower cylinder (35) (see FIG. 2.)

The blade housing holes (32, 37) are holes extending from the inner peripheral surfaces of the cylinders (30, 35) (i.e., the outer edges of the cylinder bores (31, 36)) toward the outer sides of the cylinders (30,35) in the radial direction, respectively. These blade housing holes (32, 37) pass through the cylinders (30, 35) in the thickness direction, respectively. The blade housing hole (32) in the upper cylinder (30) houses an upper blade (41). The blade housing hole (37) in the lower cylinder (35) houses a lower blade (first blade) (46). The blade housing holes (32, 37) are shaped such that wall surfaces (parts of the cylinders (30, 35) surrounding the blade housing holes (32, 37) do not interfere with the swinging blades (41, 46).

The suction ports (33, 38) are holes extending from the inner peripheral surfaces of the cylinders (30, 35) (i.e., the outer edges of the cylinder bores (31,36)) toward outside the cylinders (30, 35) in the radial direction, respectively, and have circular cross-sections. The suction ports (33, 38) are disposed near the blade housing holes (32, 37) (at the right of the blade housing holes (32, 37) in FIGS. 3 and 4 in the present embodiment) and opens to the outer surface of the cylinders (30, 35), respectively. An upper suction pipe (not shown) is inserted into the suction port (33) in the upper cylinder (30), and a lower suction pipe (not shown) is inserted into the suction port (38) in the lower cylinder (35).

(Front Head)

The front head (20) is a member for blocking the end face (upper end face in FIG. 2) of the upper cylinder (30) on the electric motor (10) side. This front head (20) includes a main body (21), a main bearing (second bearing) (22), and an outer wall portion (23).

The main body (21) has a substantially circular thick plate shape. This main body (21) is disposed so as to cover the end face of the upper cylinder (30). The lower surface of this main body (21) is in close contact with the upper cylinder (30). The main bearing (22) has a cylindrical shape extending from the main body (21) toward the electric motor (10) side (upper side in FIG. 1) and is disposed at the central portion of the main body (21). This main bearing (22) forms a journal bearing that supports a drive shaft (70) in the compression mechanism (15). The outer wall portion (23) is a thick annular portion formed continuously to the outer peripheral portion of the main body (21).

A discharge port (24) is formed in the front head (20). The discharge port (24) penetrates the main body (21) of the front head (20) in the thickness direction. As shown in FIG. 3, in the lower surface (surface in contact with the upper cylinder (30)) of the main body (21) of the front head (20), the discharge port (24) opens to the vicinity of the blade housing hole (32) in the upper cylinder (30) on the side opposite to the suction port (33) (at the left of the blade housing hole (32) in FIG. 3 in the present embodiment). Although not shown, a discharge valve for opening and closing the discharge port (24) is attached to the main body (21) of the front head (20).

(Rear Head)

The rear head (25) is a member blocking the end face (lower end face in FIG. 1) of the lower cylinder (35) on the side opposite to the electric motor (10). The rear head (25) includes a main body (26), an auxiliary bearing (first bearing) (27), and an outer wall portion (A).

The main body (26) is formed into a substantially circular thick plate shape. This main body (26) is disposed so as to cover the end face of the lower cylinder (35). The upper surface of the main body (26) is in close contact with the lower cylinder (35). The auxiliary bearing (27) has a cylindrical shape extending from the main body (26) toward the side opposite to the lower cylinder (35) (lower side in FIG. 2) and is disposed at the central portion of the main body (26). This auxiliary bearing (27) forms a journal bearing that supports a drive shaft (70) in the compression mechanism (15). The outer wall portion (28) has a cylindrical shape extending from the outer peripheral portion of the main body (26) toward the side opposite to the lower cylinder (35). The length (height) of the outer wall portion (28) is substantially equal to that of the auxiliary bearing (27).

A discharge port (29) is formed in the rear head (25). The discharge port (29) penetrates the main body (26) of the rear head (25) in the thickness direction. As shown in FIG. 4, in the upper surface (surface in contact with the lower cylinder (35)) of the main body (26) of the rear head (25), the discharge port (29) opens to the vicinity of the blade housing hole (37) in the lower cylinder (35) on the side opposite to the suction port (38) (at the left of the blade housing hole (37) in FIG. 4 in the present embodiment). Although not shown, a discharge valve for opening and closing the discharge port (29) is attached to the main body (26) of the rear head (25).

(Intermediate Plate)

As shown in FIG. 2, the intermediate plate (50) includes an upper plate member (60) and a lower plate member (65). The upper plate member (60) and the lower plate member (65) are substantially circular flat-plate members. The upper plate member (60) and the lower plate member (65) partially project toward the outside in the radial direction. Although not shown, a plurality of through holes penetrating the plate members (60, 65) in the thickness direction, such as through holes for allowing bolts for assembling the compression mechanism (15) to be inserted therein and to pass therethrough, are formed in the plate members (60, 65).

As shown in FIG. 2, the upper plate member (60) and the lower plate member (65) overlap with each other to form an intermediate plate (50). The upper plate member (60) is disposed on the upper cylinder (30) side and covers the end face (the lower surface in FIG. 2). The upper surface of the upper plate member (60) is in close contact with the upper cylinder (30). The lower plate member (65) is disposed on the lower cylinder (35) side and covers the end face (the upper surface in FIG. 2). The lower surface of the lower plate member (65) is in close contact with the lower cylinder (35). The upper surface of the lower plate member (65) is in close contact with the lower surface of the upper plate member (60).

A middle hole (51) passing through the intermediate plate (50) in the thickness direction is formed in the central portion of the intermediate plate (50), i.e., the central portion between the upper plate member (60) and the lower plate member (65). The drive shaft (70) is inserted into the middle hole (51) in the intermediate plate (50).

An upper annular projection (62) projecting toward the middle hole (51) so as to have an annular shape is formed at the upper end portion in the inner periphery of the upper plate member (60). A lower annular projection (67) projecting toward the middle hole (51) so as to has an annular shape is formed at the lower end portion in the inner periphery of the lower plate member (65). With this upper annular projection (62) and the lower annular projection (67), the diameters of the upper end portion and the lower end portion of the middle hole (51) are formed to be smaller than that of the central portion. In the present embodiment, the diameters of the upper end portion and the lower end portion of the middle hole (51) are equally $\varphi D_o$. The diameters $\varphi D_o$ of the upper end portion and the lower end portion of this middle hole (51) are larger than the outer diameter $\varphi D_{eL}$ of the lower eccentric portion (76) and is smaller than the outer diameter $\varphi D_{eU}$ of the upper eccentric portion (75) ($\varphi D_{e1}<\varphi D_o<\varphi D_{eU}$.)

(Drive Shaft)

As shown in FIGS. 1 and 2, the drive shaft (70) includes a main shaft portion (second shaft portion) (72), an upper eccentric portion (second eccentric portion) (75), an intermediate coupling portion (80), a lower eccentric portion (first eccentric portion) (76), a lower coupling portion (first coupling portion) (90), and an auxiliary shaft portion (first shaft portion) (74). Here, the overview of the drive shaft (70) is described. The detailed structure of the drive shaft (70) will be described later.

A main shaft portion (72), an upper eccentric portion (75), an intermediate coupling portion (80), a lower eccentric portion (76), a lower coupling portion (90), and an auxiliary shaft portion (74) in the drive shaft (70) are downwardly disposed in this order from the top. The main shaft portion (72), the upper eccentric portion (75), the intermediate coupling portion (80), the lower eccentric portion (76), the lower coupling portion (90), and the auxiliary shaft portion (74) in the drive shaft (70) are formed integrally.

The main shaft portion (72) and the auxiliary shaft portion (74) are cylindrical or rod-shaped portions having circular cross sections. A rotor (12) of the electric motor (10) is attached to the upper part of the main shaft portion (72). A lower part of the main shaft portion (72) forms a journal that is supported by the main bearing (22) in the front head (20), and the auxiliary shaft portion (74) forms a journal that is supported by the auxiliary bearing (27) in the rear head (25). The outer diameter of the auxiliary shaft portion (74) is smaller than that of the main shaft portion (72). The drive shaft (70) is configured to satisfy $2R_S<2R_M$, wherein $R_M$ (the radius $R_2$ of the second shaft portion) is the radius of the main shaft portion (72), and $R_S$ (the radius $R_1$ of the first shaft portion) is the radius of the auxiliary shaft portion (74).

Eccentric portions (75, 76) are cylindrical portions each having a diameter larger than that of the main shaft portion (72). The upper eccentric portion (75) forms a second eccentric portion, and the lower eccentric portion (76) forms a first eccentric portion. The central axes (75*a*, 76*a*) of the respective eccentric portions (75, 76) are eccentric to the rotational center axis (70*a*) of the drive shaft (70) (see FIG. 6.) The upper eccentric portion (75) is eccentric to the side opposite to the lower eccentric portion (76) with respect to the rotational center axis (70*a*) of the drive shaft (70). As shown in FIG. 2, the outer diameter $\varphi D_{eL}$ of the lower eccentric portion (76) is smaller than the outer diameter $\varphi D_{eU}$ of the upper eccentric portion (75) ($\varphi D_{eL}<\varphi D_{eU}$.)

The intermediate coupling portion (80) is disposed and couples between the upper eccentric portion (75) and the lower eccentric portion (76). The lower coupling portion (90) is disposed and couples between the lower eccentric portion (76) and the auxiliary shaft portion (74).

An oil supply passage (71) is formed in the drive shaft (70) (see FIG. 2.) A lubricant remaining at the bottom of the casing (2) is supplied to a bearing of the drive shaft (70) and a sliding portion of the compression mechanism (15) via the oil supply passage (71).

(Upper Piston, Lower Piston)

As shown in FIGS. 3 and 4, the pistons (40, 45) are slightly thick cylindrical members. The upper piston (40) forms a second piston, and the lower piston (45) forms a first piston. As shown in FIG. 2, the height $H_{PU}$ of the upper piston (40) is equal to the height Fin of the lower piston (45) ($H_{PU}=H_{PL}$.) The outer diameter $\varphi D_{PU}$ of the upper piston (40) is equal to the outer diameter $\varphi D_{PL}$ of the lower piston (45). The inner diameter of the lower piston (45) is smaller than that of the upper piston (40). Accordingly, the thickness of the lower piston (45) in the radial direction is larger than that of the upper piston in the radial direction.

As shown in FIGS. 2 and 3, the upper eccentric portion (75) of the drive shaft (70) is rotatably fitted in the upper piston (40). In the upper piston (40), the outer peripheral surface slides on the inner peripheral surface of the upper cylinder (30), one end surface slides on the lower surface of the main body (21) of the front head (20), and the other end surface slides on the upper surface of the upper plate member (60) of the intermediate plate (50). In the compression mechanism (15), a compression chamber (second compression chamber) (34) is formed between the outer peripheral surface of the upper piston (40) and the inner peripheral surface of the upper cylinder (30).

As shown in FIGS. 2 and 4, the lower eccentric portion (76) of the drive shaft (70) is rotatably fitted in the lower piston (45). In the lower piston (45), the outer peripheral surface slides on the inner peripheral surface of the lower cylinder (35), one end surface slides on the upper surface of the main body (21) of the rear head (25), and the other end surface slides on the lower surface of the lower plate member (65) of the intermediate plate (50). In the compression mechanism (15), a compression chamber (first compression chamber) (39) is formed between the outer peripheral surface of the lower piston (45) and the inner peripheral surface of the lower cylinder (35).

Figure 5:
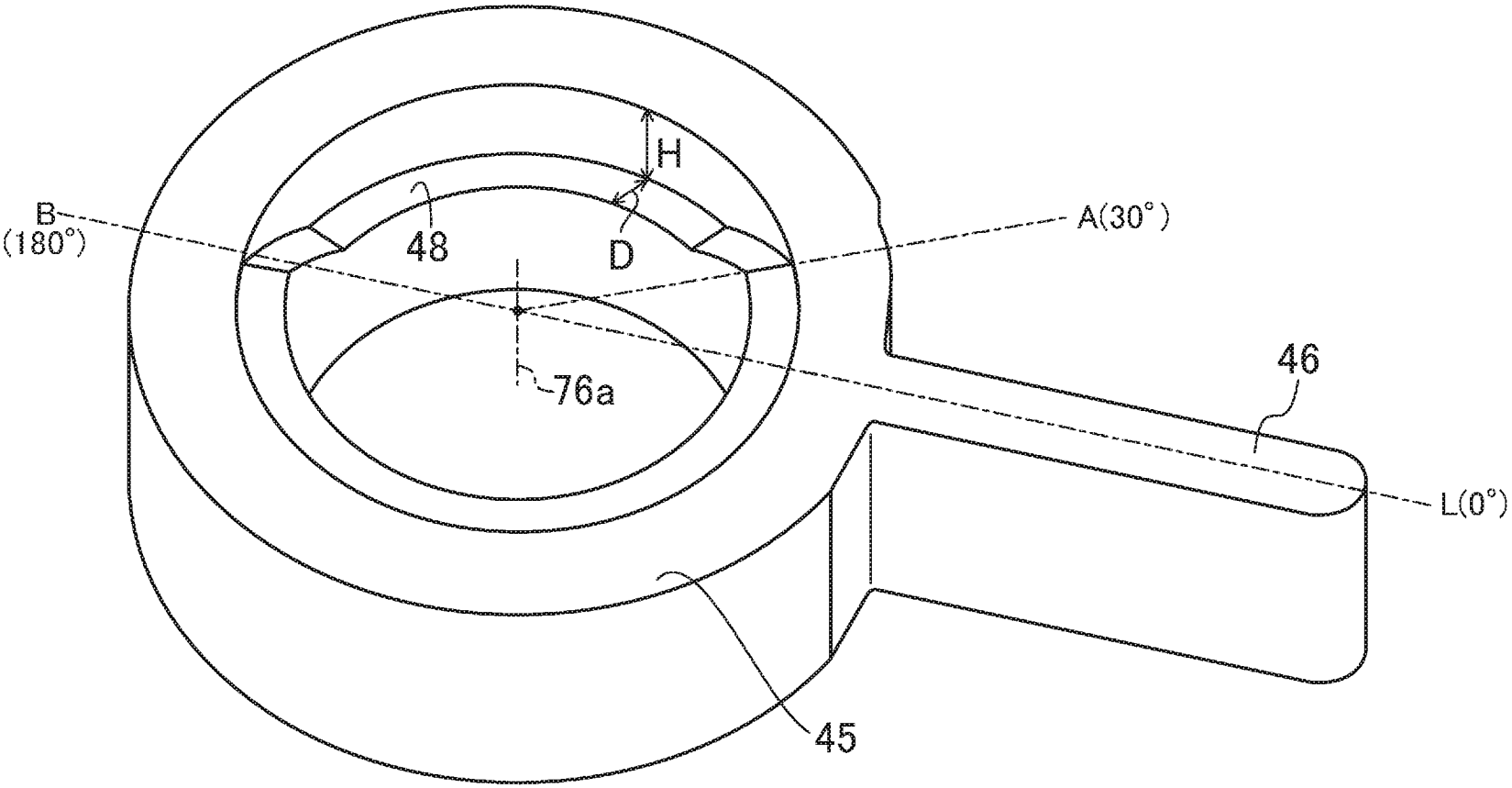
FIG. 5 is a perspective view illustrating a lower surface of the lower piston in the rotary compressor.

As shown in FIGS. 2, 4, and 5, an inner peripheral groove (48) is formed in the lower piston (45). Here, only the overview of the inner peripheral groove (48) is described, and the detailed structure will be described later.

The inner peripheral groove (48) is a long and narrow depression formed entirely in a part of the inner peripheral surface of the lower piston (45) in the circumferential direction of the inner peripheral surface. The inner peripheral groove (48) is formed along the lower end of the inner peripheral surface of the lower piston (45) and opens to the lower end of the lower piston (45) in FIG. 2. The inner peripheral groove (48) of the lower piston (45) has a maximum value (maximum depth) of a depth (a length of the lower piston (45) in the radial direction) of "D", and a height (a length of the lower piston (45) in the central axis direction) of "H" (see FIGS. 2, 5, and 16A.)

(Upper Blade, Lower Blade)

The blades (41, 46) are rectangular plate members. The upper blade (41) is integrally formed with an upper piston (40), and the lower blade (46) is integrally formed with a lower piston (45). The blades (41, 46) project toward the outside in the radial direction from the respective outer surfaces of the corresponding pistons (40, 45). The widths of the blades (41, 46) (the lengths of the pistons (40.45) in the axial direction) are equal to the heights ($H_{PU}$, $H_{PL}$) of the corresponding pistons (40, 45), respectively. The full lengths of the blades (41, 46) (the lengths of the pistons (40, 45) in the radial direction) are equal to each other.

The upper blade (41) integrally formed with the upper piston (40) is fitted in the blade housing hole (32) in the upper cylinder (30). The upper blade (41) partitions the compression chamber (34) formed in the upper cylinder (30) into a low-pressure chamber on the suction port (33) side and a high-pressure chamber on the discharge port (24) side.

The lower blade (46) integrally formed with the lower piston (45) is fitted in the blade housing hole (37) in the lower cylinder (35). The lower blade (46) partitions the compression chamber (39) formed in the lower cylinder (35) into a low-pressure chamber on the suction port (38) side and a high-pressure chamber on the discharge port (29) side.

(Bush)

A pair of bushes (42) are provided in the upper cylinder (30), and a pair of bushes (47) are provided in the lower cylinder (35). The bushes (42, 47) are small plate members each having a flat facing front surface and an arc back surface.

A pair of bushes (42) provided in the upper cylinder (30) are disposed so as to sandwich the upper blade (41) fitted in the blade housing hole (32) in the upper cylinder (30) from both sides. The upper blade (41) integrally formed with the upper piston (40) is supported by the upper cylinder (30) to freely oscillate and move back and forth via these bushes (42), In the present embodiment, with this pair of bushes (42) and this upper blade (41), the upper piston (40) is configured as an swinging piston that oscillates with respect to the central axis (75*a*) of the upper eccentric portion (75) while revolving along the inner wall surface of the upper cylinder (30) along with rotation of the drive shaft (70).

A pair of bushes (47) provided in the lower cylinder (35) are disposed so as to sandwich the lower blade (46) fitted in the blade housing hole (37) in the lower cylinder (35) from both sides. The lower blade (46) integrally formed with the lower piston (45) is supported by the lower cylinder (35) to freely oscillate and move back and forth via these bushes (47). In the present embodiment, with this pair of bushes (47) and this lower blade (46), the lower piston (45) is configured as an swinging piston that oscillates with respect to the central axis (76*a*) of the lower eccentric portion (76) while revolving along the inner wall surface of the lower cylinder (35) along with rotation of the drive shaft (70).

Detailed Structure of Drive Shaft

As mentioned above, the drive shaft (70) includes a main shaft portion (72), an upper eccentric portion (75), an intermediate coupling portion (80), a lower eccentric portion (76), a lower coupling portion (90), and an auxiliary shaft portion (74). The detailed structure of the drive shaft (70) will be described with reference to FIGS. 6 to 15. In this description, "right" and "left" refer to "right" and "left" in FIGS. 6 to 15, respectively. In FIGS. 6 to 15, "left side" refers to the first direction that is the eccentric direction of the lower eccentric portion (76) that is the first eccentric portion, and "right side" refers to the second direction that is the eccentric direction of the upper eccentric portion (75) that is the second eccentric portion.

[Configuration of Each Component]

(Main Shaft Portion, Auxiliary Shaft Portion)

Figure 6:
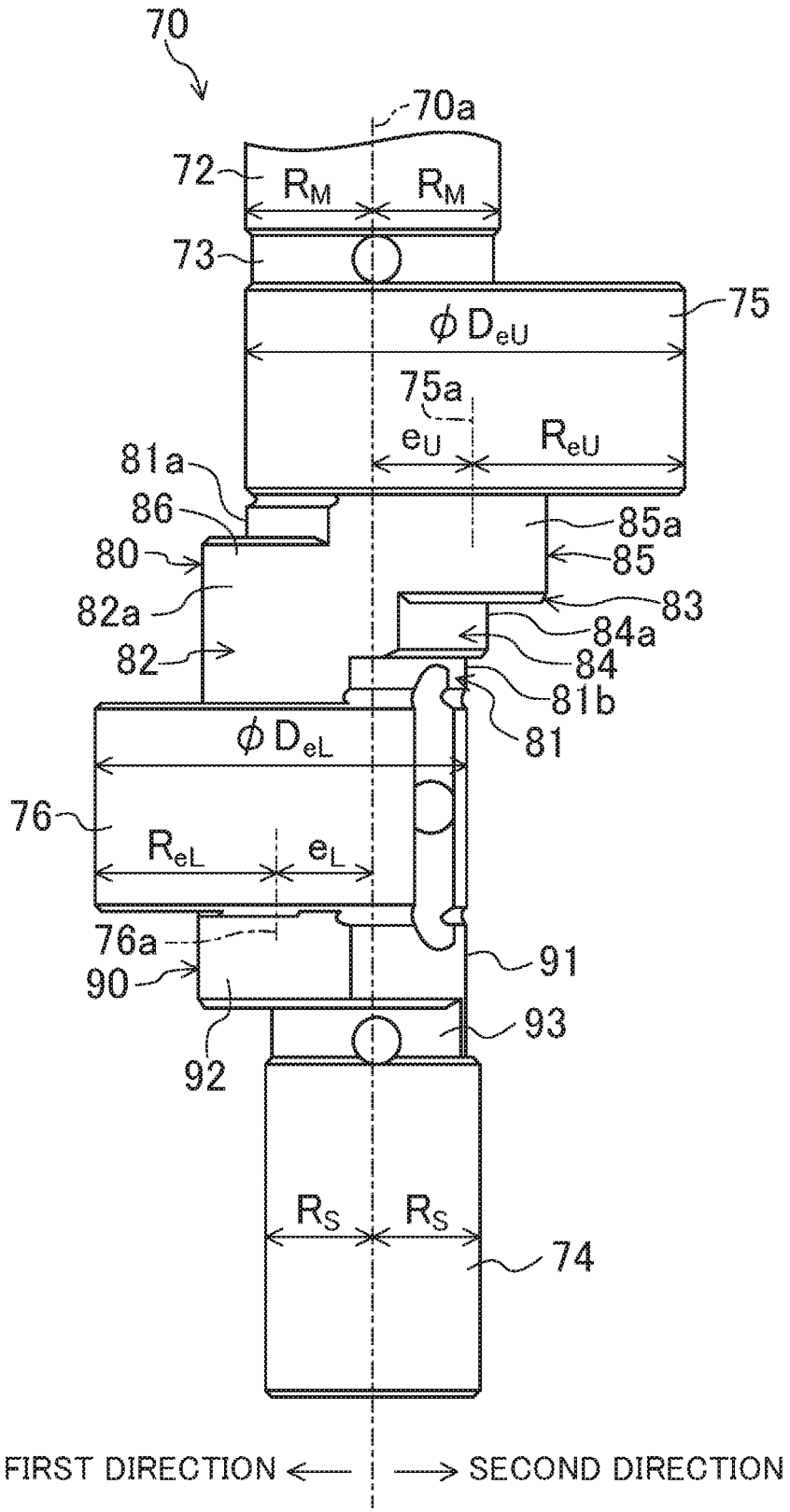
FIG. 6 is a front view illustrating essential components of a drive shaft in the rotary compressor.
Figure 7:
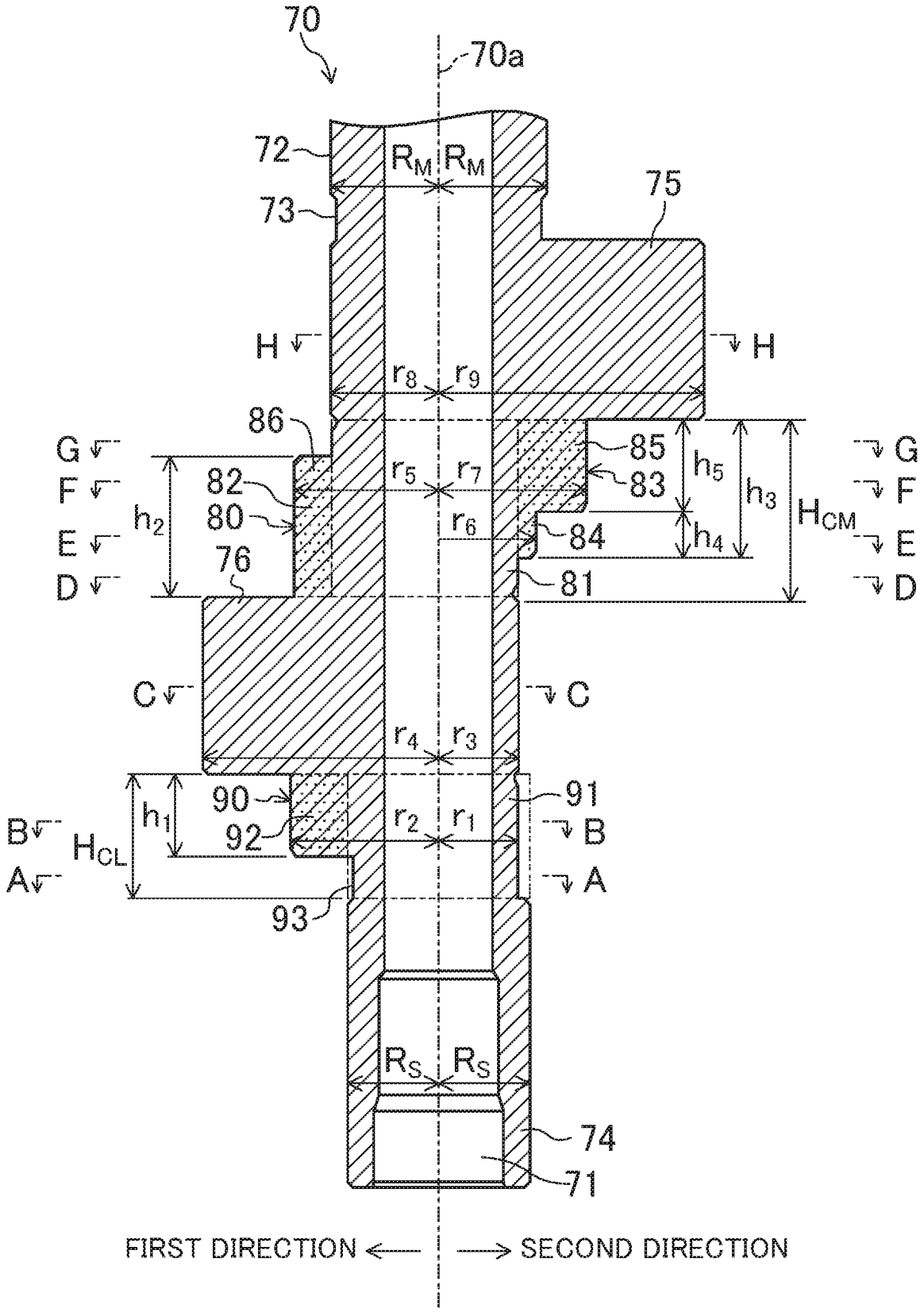
FIG. 7 is a vertical cross-sectional view illustrating essential components of the drive shaft in the rotary compressor.

As mentioned above, the main shaft portion (72) and the auxiliary shaft portion (74) are cylindrical or rod-shaped portions having circular cross sections. The central axes of the main shaft portion (72) and the auxiliary shaft portion (74) coincide with the rotational center axis (70*a*) of the drive shaft (70). The outer diameter of the main shaft portion (72) is substantially constant over the entire length of the main shaft portion (72). The outer diameter of the auxiliary shaft portion (74) is substantially constant over the entire length of the auxiliary shaft portion (74). As shown in FIGS. 6 and 7, the outer diameter of the auxiliary shaft portion (74) is slightly smaller than that of the main shaft portion (72). The drive shaft (70) is configured to satisfy $2R_S<2R_M$, wherein $R_M$ (the radius $R_2$ of the second shaft portion) is the radius of the main shaft portion (72), and $R_S$ (the radius $R_1$ of the first shaft portion) is the radius of the auxiliary shaft portion (74).

An upper oil supply groove (73) is formed on the main shaft portion (72) by slightly constricting an end portion (lower end portion in FIG. 6) connected to the upper eccentric portion (75). The lubricant is supplied from the oil supply passage (71) to the upper oil supply groove (73).

(Upper Eccentric Portion, Lower Eccentric Portion)

As mentioned above, the upper eccentric portion (75) and the lower eccentric portion (76) are cylindrical portions each having a larger diameter than the main shaft portion (72). The outer diameter $\varphi D_{eL}$ of the lower eccentric portion (76) is smaller than the outer diameter $\varphi D_{eU}$ of the upper eccentric portion (75) ($\varphi D_{eL}<\varphi D_{eU}$.) The height (i.e., the length in the rotational center axis (70*a*) direction of the drive shaft (70)) of the upper eccentric portion (75) is substantially equal to that of the lower eccentric portion (76). The height of the upper eccentric portion (75) is slightly smaller than the height $H_{PU}$ of the upper piston (40), and the height of the lower eccentric portion (76) is slightly lower than the height $H_{PL}$ of the lower piston (45).

Further, when the eccentric direction of the lower eccentric portion (76) with respect to the rotational center axis (70*a*) of the drive shaft (70) is set to the first direction, the upper eccentric portion (75) is eccentric in the second direction opposite to the first direction. That is, the eccentric direction of the upper eccentric portion (75) with respect to the rotational center axis (70*a*) of the drive shaft (70) is different from the eccentric direction of the lower eccentric portion (76) with respect to the rotational center axis (70*a*) of the drive shaft (70) by 180°.

As shown in FIG. 6, the eccentricity $e_U$ of the upper eccentric portion (75) (eccentricity $e_2$ of the second eccentric portion) is equal to the eccentricity $e_L$ of the lower eccentric portion (76) (eccentricity $e_1$ of the first eccentric portion) ($e_U=e_L$.) The eccentricity $e_U$ of the upper eccentric portion (75) refers to the distance between the central axis (75*a*) of the upper eccentric portion (75) and the rotational center axis (70*a*) of the drive shaft (70). The eccentricity $e_L$ of the lower eccentric portion (76) refers to the distance between the central axis (76*a*) of the lower eccentric portion (76) and the rotational center axis (70*a*) of the drive shaft (70).

Figure 10:
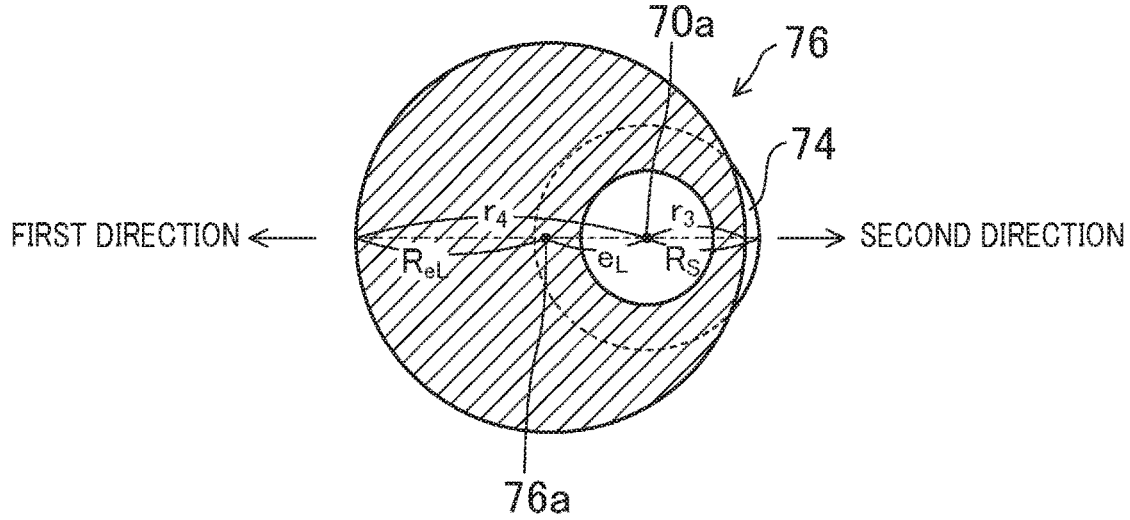
FIG. 10 is a transverse cross-sectional view illustrating a cross section of the drive shaft taken along line C-C in FIG. 7.
Figure 11:
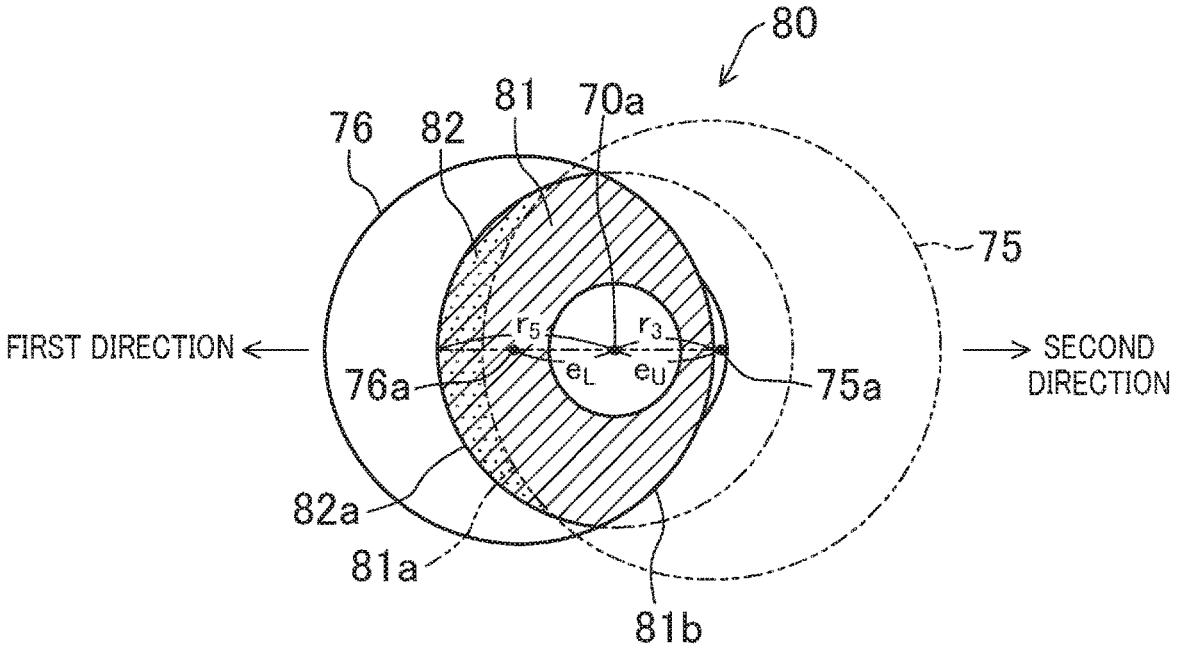
FIG. 11 is a transverse cross-sectional view illustrating a cross section of the drive shaft taken along line D-D in FIG. 7.

In FIGS. 6, 7, and 10, assuming that the radius of the lower eccentric portion (76) is represented by $R_{e1}$, (radius $R_{e1}$ of the first eccentric portion), n represents the minimum value ($r_3=R_{e1}-e_L$) of the distance from the rotational center axis (70*a*) of the drive shaft (70) to the outer peripheral surface of the lower eccentric portion (76), and $r_4$ represents the maximum value ($r_4=R_{eL}+e_L$) of the distance. In the drive shaft (70) of the present embodiment, the distance $r_3$ is smaller than the radius $R_S$ of the auxiliary shaft portion (74).

Figure 15:
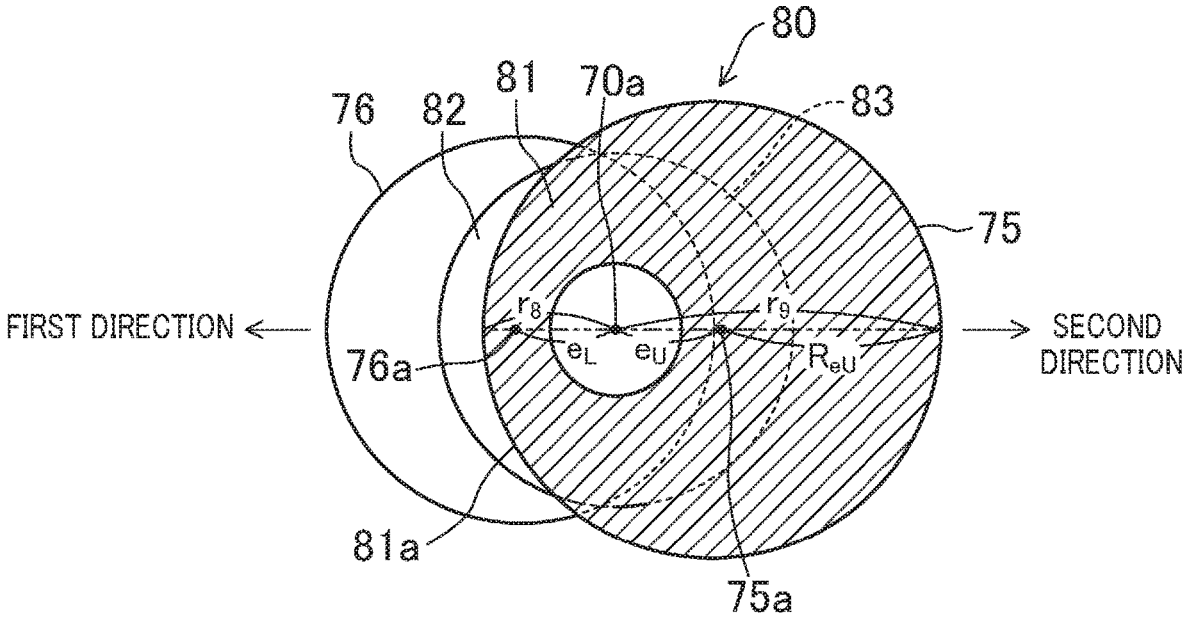
FIG. 15 is a transverse cross-sectional view illustrating a cross section of the drive shaft taken along line H-H in FIG. 7.

In FIGS. 6, 7, and 15, assuming that the radius of the upper eccentric portion (75) is represented by $R_{eU}$ (radius $R_{e2}$ of the second eccentric portion represents the minimum value ($r_8=R_{eU}-e_U$) of the distance from the rotational center axis (70*a*) of the drive shaft (70) to the outer peripheral surface of the upper eccentric portion (75), and $r_9$ represents the maximum value ($r_9=R_{eU}+e_U$) of the distance. In the drive shaft (70) according to the present embodiment, the distance r8 is substantially equal to the radius RM of the main shaft portion (72). The distance $r_8$ is only required to be the radius $R_M$ of the main shaft portion (72) or more ($r_8=R_{eU}-e_U \geq R_M$) and is not necessarily equal to the radius $R_M$ of the main shaft portion (72).

(Lower Coupling Portion)

As shown in FIG. 6, the lower coupling portion (90) is disposed between the auxiliary shaft portion (74) and the lower eccentric portion (76). As shown in FIGS. 6 to 9, the lower coupling portion (90) includes the main body (91) and the reinforcement portion (92). The main body (91) and the reinforcement portion (92) are integrally formed.

Figure 8:
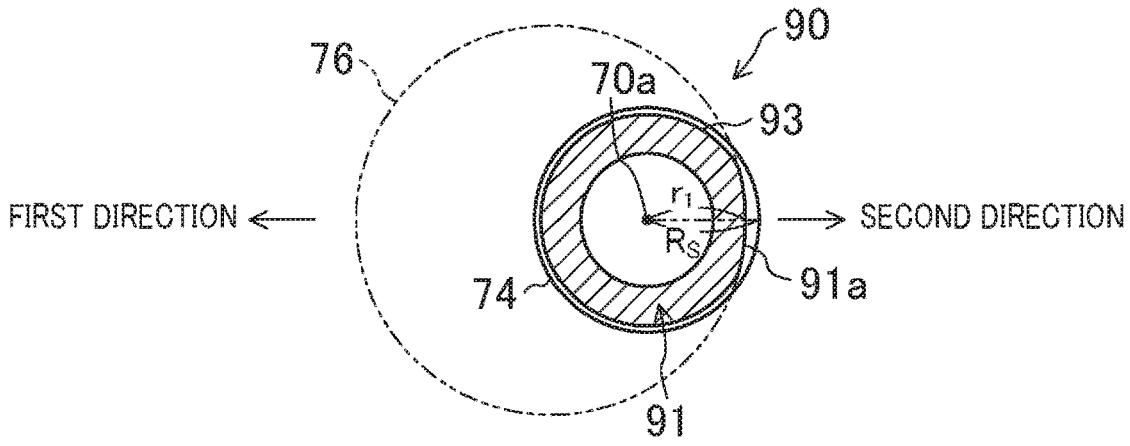
FIG. 8 is a transverse cross-sectional view illustrating a cross section of the drive shaft taken along line A-A in FIG. 7.
Figure 9:
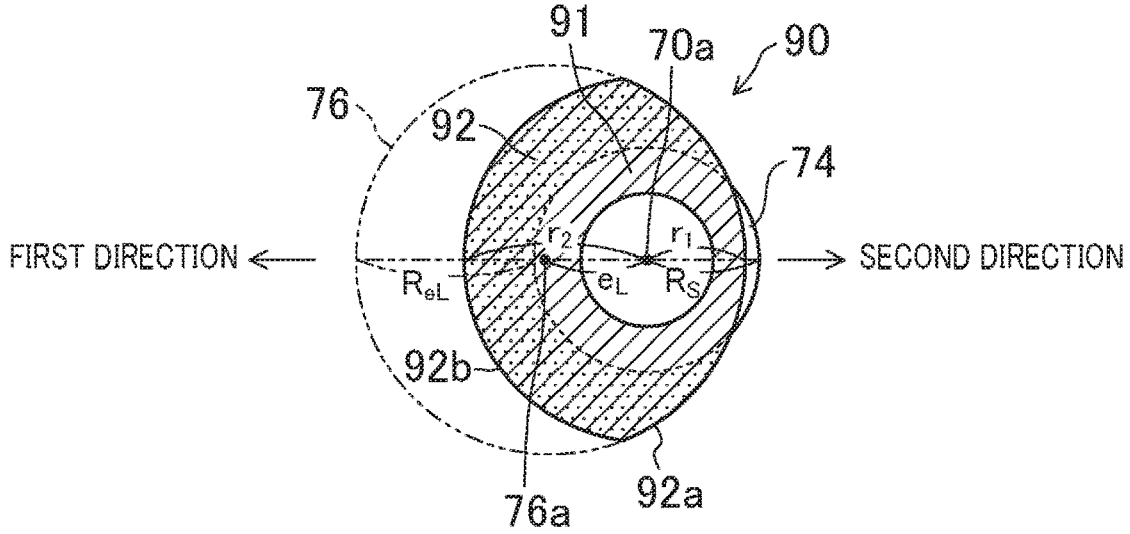
FIG. 9 is a transverse cross-sectional view illustrating a cross section of the drive shaft taken along line B-B in FIG. 7.

As shown in FIGS. 7 to 9, the main body (91) is a substantially cylindrical portion that is coaxial with the rotational center axis (70*a*) of the drive shaft (70) formed continuously above the auxiliary shaft portion (74) and that has the same radius $R_S$ ($R_1$) as the auxiliary shaft portion (74). The second direction side of the main body (91) is partially cut away so that the main body (91) does not extend outward from the outer peripheral surface of the lower eccentric portion (76) in the radial direction of the drive shaft (70). Specifically, the second direction side of the main body (91) is partially cut away by a part (arc surface) of a cylindrical surface, with its central axis coincides with the central axis (76*a*) and with a radius identical to the radius $R_{eL}$ of the lower eccentric portion (76) (see FIGS. 8 and 9.) In other words, the outer surface (910 of the main body (91) on the second direction side is configured as a part (arc surface) of a cylindrical surface, with its central axis coincides with the central axis (76*a*) and with a radius identical to the radius $R_{eL}$ of the lower eccentric portion (76).

As shown in FIGS. 6 and 9, a lower oil supply groove (93) is formed in the main body (91) by constricting an end portion (lower end portion in FIG. 6) connected to the auxiliary shaft portion (74) to be thinner than the auxiliary shaft portion (74). The lower oil supply groove (93) is formed around the whole circumference of the drive shaft (70), and a lubricant is supplied from the oil supply passage (71).

The reinforcement portion (92) is a portion protruded from the outer peripheral portion of the main body (91) formed above the lower oil supply groove (93) of the main body (91) toward the first direction side (see FIGS. 7 and 9.) As shown in FIG. 9, the reinforcement portion (92) is formed such that its outer surfaces (92*a*, 92*b*) do not extend out of the outer peripheral surface of the lower eccentric portion (76) in the radial direction of the drive shaft (70) and are positioned outside the outer peripheral surface of the auxiliary shaft portion in the radial direction of the drive shaft (70).

Specifically, as shown in FIG. 9, the outer surfaces (92*a*, 92*b*) of the reinforcement portion (92) are configured as a part (art surface) of a cylindrical surface with its central axis coincides with the central axis (76*a*) of the lower eccentric portion (76) and with a radius identical to the rotational center axis $R_{eL}$ of the lower eccentric portion (76) and a part (arc surface) of a cylindrical surface with its central axis coincides with the rotational center axis (70*a*) of the drive shaft (70) and with a radius $r_2$.

Between the outer surfaces (92*a*, 92*b*) of the reinforcement portion (92), the right surface (92*a*) on the second direction side (right side in FIG. 9) is configured as a part (arc surface) of the cylindrical surface, with its central axis coinciding with the central axis (76*a*) of the lower eccentric portion (76) and with a radius identical to the radius $R_{eL}$ of the lower eccentric portion (76). The minimum distance $r_1$ from the rotational center axis (70*a*) of the drive shaft (70) to the right surface (92*a*) of the reinforcement portion (92) is smaller than the radius $R_S$ of the auxiliary shaft portion (74) ($r_1<R_S$). The maximum distance from the rotational center axis (70*a*) of the drive shaft (70) to the right surface (92*a*) of the reinforcement portion (92) is identical to the radius $r_2$ of a part (arc surface) of the cylindrical surface configured as a left surface (92*b*) to be described later and is larger than the radius $R_S$ of the auxiliary shaft portion (74) ($r_2>R_S$). With such a configuration, a middle portion of the right surface (92*a*) of the reinforcement portion (92) in the circumferential direction is positioned inside the outer peripheral surface of the auxiliary shaft portion (74), and parts on the both sides other than the middle portion in the circumferential direction are positioned outside the outer peripheral surface of the auxiliary shaft portion (74).

In the present embodiment, the minimum distance $r_1$ from the rotational center axis (70*a*) of the drive shaft (70) to the right surface (92*a*) of the reinforcement portion (92) is substantially equal to the minimum distance $r_3$ from the rotational center axis 70*a* of the drive shaft (70) to the outer peripheral surface of the lower eccentric portion (76). That is, the right surface (92*a*) is formed so as not to extend out of the outer peripheral surface of the lower eccentric portion (76) in the radial direction of the drive shaft (70). The distance $r_1$ for this reinforcement portion (92) may be the distance $r_3$ for the lower eccentric portion (76) or less ($r_1 \leq r_3$.)

Between the outer surfaces (92*a*, 92*b*) of the reinforcement portion (92), the left surface (92*b*) on the first direction side (left side in FIG. 9) is configured as a part (a surface) of the cylindrical surface with its central axis coincides with the rotational center axis (70*a*) of the drive shaft (70) and with the radius $r_2$. The radius $r_2$ of the left surface (92*b*) is larger than the radius $R_S$ of the auxiliary shaft portion (74) ($r_2>R_S$.) The left surface (92*b*) is formed so as not to extend out of the outer peripheral surface of the lower eccentric portion (76) in the radial direction of the drive shaft (70). That is, the left surface (92*b*) is formed so as not to extend out of the outer peripheral surface of the lower eccentric portion (76) and is formed outside the outer peripheral surface of the auxiliary shaft portion (74) in the radial direction of the drive shaft (70).

With such as a configuration, a lower coupling portion (first coupling portion) (90) is formed between the lower eccentric portion (76) and the auxiliary shaft portion (74) such that its outer surface does not extend out of the outer peripheral surface of the lower eccentric portion (76) in the radial direction of the drive shaft (70). When the lower piston (45) is moved from the auxiliary shaft portion (74) side in the axial direction of the drive shaft (70) so as to be fitted to the lower eccentric portion (76) in a process of assembling a compression mechanism (15) to be described later in the rotary compressor (1), by providing the lower coupling portion (90), the lower piston (45) can be moved on the outer periphery of the lower coupling portion (90) to the position where the lower piston (45) can be fitted to the lower eccentric portion (76) in the radial direction of the drive shaft (70) (position where the inner peripheral surface of the lower piston (45) is positioned outside the outer peripheral surface of the lower eccentric portion (76) in the radial direction of the drive shaft (70)) (see FIG. 16A.) The process will be described in detail later.

The $H_{CL}$ shown in FIG. 7 represents the height of the lower coupling portion (90) (i.e., the length of the drive shaft (70) in the rotational center axis (70*a*) direction), and the height $H_{CL}$ of the lower coupling portion (90) is substantially identical to the distance from the upper end of the auxiliary shaft portion (74) to the lower end of the lower eccentric portion (76) in FIG. 7. The height $h_1$ of the reinforcement portion (92) is higher than half the height of the lower coupling portion (90) ($h_1>H_{CL}/2$.)

The lower coupling portion (90) is formed so that the height $H_{CL}$ is lower than the height $H_{PL}$ of the lower piston (45) ($H_{CL}<H_{PL}$.)

As mentioned above, in order to shift the lower piston (45) on the outer periphery of the lower coupling portion (90) to the position where the lower piston (45) can be fitted to the lower eccentric portion (76) at the time when the lower piston (45) is fitted to the lower eccentric portion (76) from the auxiliary shaft portion (74) side, the height $H_{CL}$ of the lower eccentric portion (90) is required to be higher than the height $H_{PL}$ of the lower piston (45).

However, in the present embodiment, the height $H_{CL}$ of the lower coupling portion (90) is brought to be lower than the height $H_{PL}$ of the lower piston (45) by forming an inner peripheral groove (48) with a height H larger than "the difference between the height $H_{PL}$ of the lower piston (45) and the height $H_{CL}$ of the lower coupling portion (90) ($H>H_{PL}-H_{CL}$) and a maximum depth D larger than "the difference between the radius $R_S$ of the auxiliary shaft portion (74) and the distance $r_3$ ($=R_{eL}-e_L$) for the lower eccentric portion (76)" ($D>R_S-(R_{eL}-e_L)$) in the lower piston (45). This will be described in detail later.

(Intermediate Coupling Portion)

As shown in FIG. 6, the intermediate coupling portion (80) is a portion disposed between the upper eccentric portion (75) and the lower eccentric portion (76). As shown in FIGS. 6, 7, and 11 to 14, the intermediate coupling portion (80) includes a main body (81), a lower intermediate reinforcement portion (first intermediate reinforcement portion (82), and an upper intermediate reinforcement portion (second intermediate reinforcement portion) (83). The main body (81), the lower intermediate reinforcement portion (82), and the upper intermediate reinforcement portion (83) are formed integrally. As shown in FIGS. 6 and 7, the lower intermediate reinforcement portion (82) and the upper intermediate reinforcement portion (83) overlap with each other in an axial direction of the drive shaft (70).

As shown in FIGS. 7 and 11 to 14, the main body (81) is a columnar portion at which extended portions of the upper eccentric portion (75) and the lower eccentric portion (76) overlap with each other when the upper eccentric portion (75) and the lower eccentric portion (76) are extended between the upper eccentric portion (75) and the lower eccentric portion (76). Specifically, between the outer surfaces (81*a*, 81*b*) of the main body (81), the right surface (81*b*) on the second direction side (right side of FIG. 11) is configured as a part (arc surface) of the cylindrical surface, with its central axis coincides with the central axis (76*a*) of the lower eccentric portion (76) and with a radius being the radius $R_{eL}$ of the lower eccentric portion (76). Between the outer surfaces (81*a*, 81*b*) of the main body (81), the left surface (81*a*) on the first direction side (left side of FIG. 14) is configured as a part (arc surface) of the cylindrical surface, with its central axis coincides with the central axis (75*a*) of the upper eccentric portion (75) and with a radius identical to the radius $R_{eU}$ of the upper eccentric portion (75). Further, the main body (81) is partially cut out at the cylindrical surface with its central axis coincides with the rotational center axis (70*a*) of the drive shaft (70) and with radius $r_5$ so as not to extend out of the cylindrical surface in the radial direction of the drive shaft (70).

The lower intermediate reinforcement portion (82) is a portion provided adjacent to the lower eccentric portion (76) and protruded from the outer peripheral portion of the main body (91) toward the first direction side (see FIGS. 7 and 11 to 13.)

Specifically, outer surface (82*a*) of the lower intermediate reinforcement portion (82) is configured as a part (arc surface) of the cylindrical surface with its central axis coincides with the rotational center axis (70*a*) of the drive shaft (70) and with radius $r_5$. The radius $r_5$ of this arc surface is larger than the minimum distance $r_8$ from the rotational center axis (70*a*) of the drive shaft (70) to the outer peripheral surface of the upper eccentric portion (75), and is smaller than the maximum distance $r_4$ from the rotational center axis (70*a*) of the drive shaft (70) to the outer peripheral surface of the lower eccentric portion (76) ($r_8<r_5<r_4$.)

With this configuration, the lower intermediate reinforcement portion (82) is formed in an area on the first direction side and is formed such that its outer surface (82*a*) is positioned inside the outer peripheral surface of the lower eccentric portion (76) and positioned outside the outer peripheral surface of the upper eccentric portion (75) in the radial direction of the drive shaft (70).

The $H_{CM}$ shown in FIG. 7 represents the height of the intermediate coupling portion (80) (i.e., the length of the drive shaft (70) in the rotational center axis (70*a*) direction), and the height $H_{CM}$ of the intermediate coupling portion (80) is substantially identical to the distance from the upper end of the lower eccentric portion (76) to the lower end of the upper eccentric portion (75) in FIG. 7. The height $h_2$ of the lower intermediate reinforcement portion (82) is higher than half the height of the intermediate coupling portion (80) ($h_2>H_{CM}/2$).

The upper intermediate reinforcement portion (83) is a portion provided adjacent to the upper eccentric portion (75) and protruded from the outer peripheral portion of the main body (91) toward the second direction side FIGS. 7 and 12 to 14.) The upper intermediate reinforcement portion (83) includes a lower small protrusion (84) with a smaller protrusion amount from the outer peripheral portion of the main body (91) surd an upper large protrusion (85) with a larger protrusion amount from the outer peripheral portion of the main body (91) than the small protrusion (84). The large protrusion (85) is adjacent to the upper eccentric portion (75), and the small protrusion (84) is adjacent to the larger protrusion (85) in the axial direction of the drive shaft (70).

Figure 12:
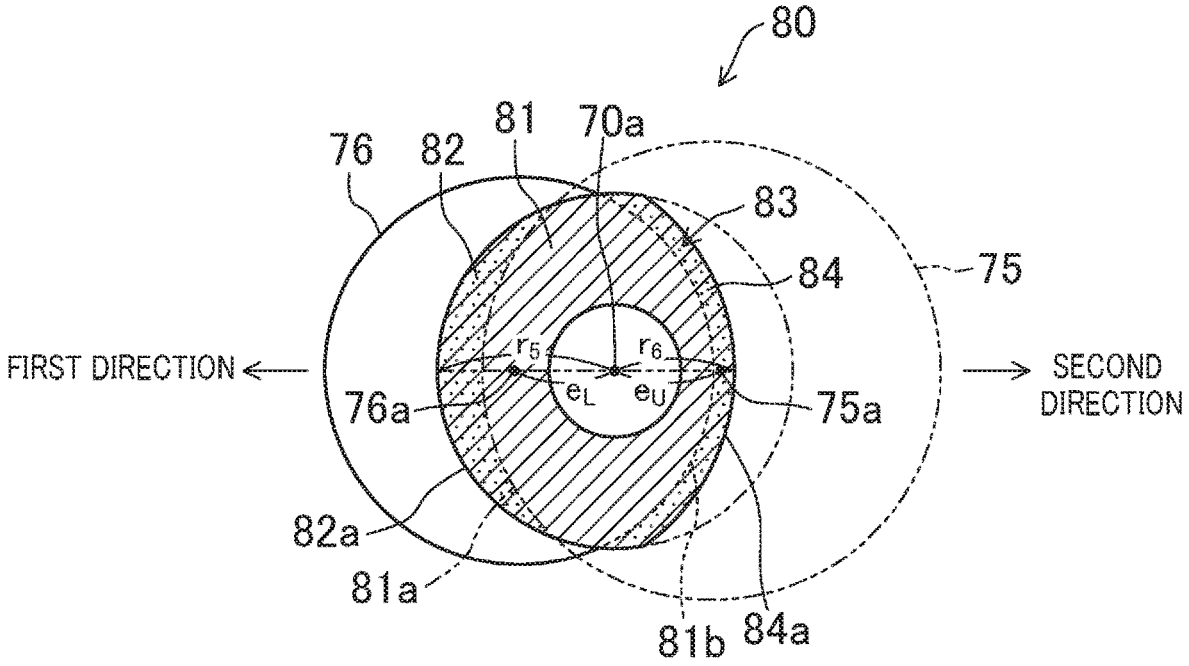
FIG. 12 is a transverse cross-sectional view illustrating a cross section of the drive shaft taken along line E-E in FIG. 7.

As shown in FIG. 12, the outer surface (84*a*) of the small protrusion (84) in the upper intermediate reinforcement portion (83) is configured as a part (arc surface) of the cylindrical surface with its central axis coinciding with the central axis (76*a*) of the lower eccentric portion (76) and with a radius larger than the radius $R_{eL}$ of the lower eccentric portion (76). As shown in FIG. 7, the minimum distance $r_6$ from the rotational center axis (70*a*) of the drive shaft (70) to the outer surface (84*a*) of the small protrusion (84) is larger than minimum distance $r_9$ from the rotational center axis (70*a*) of the drive shaft (70) to the outer peripheral surface of the lower eccentric portion (76) and is smaller than the maximum distance $r_9$ from the rotational center axis (70*a*) of the drive shaft (70) to the outer peripheral surface of the upper eccentric portion (75) ($r_3<r_6<r_9$.)

Figure 13:
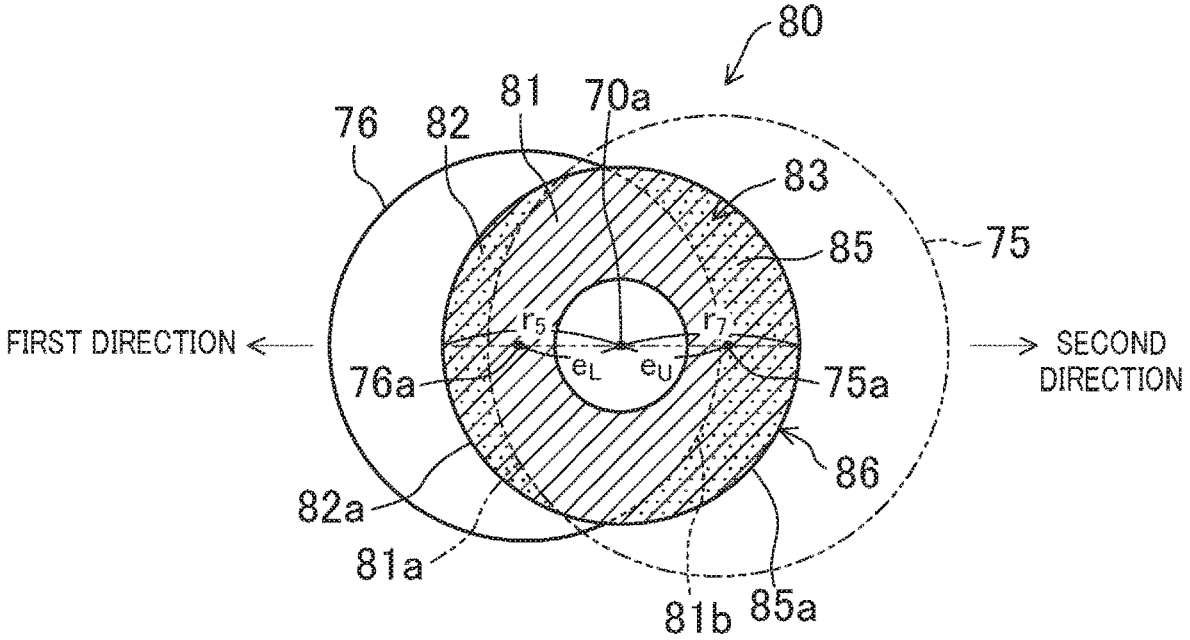
FIG. 13 is a transverse cross-sectional view illustrating a cross section of the drive shaft taken along line F-F in FIG. 7.
Figure 14:
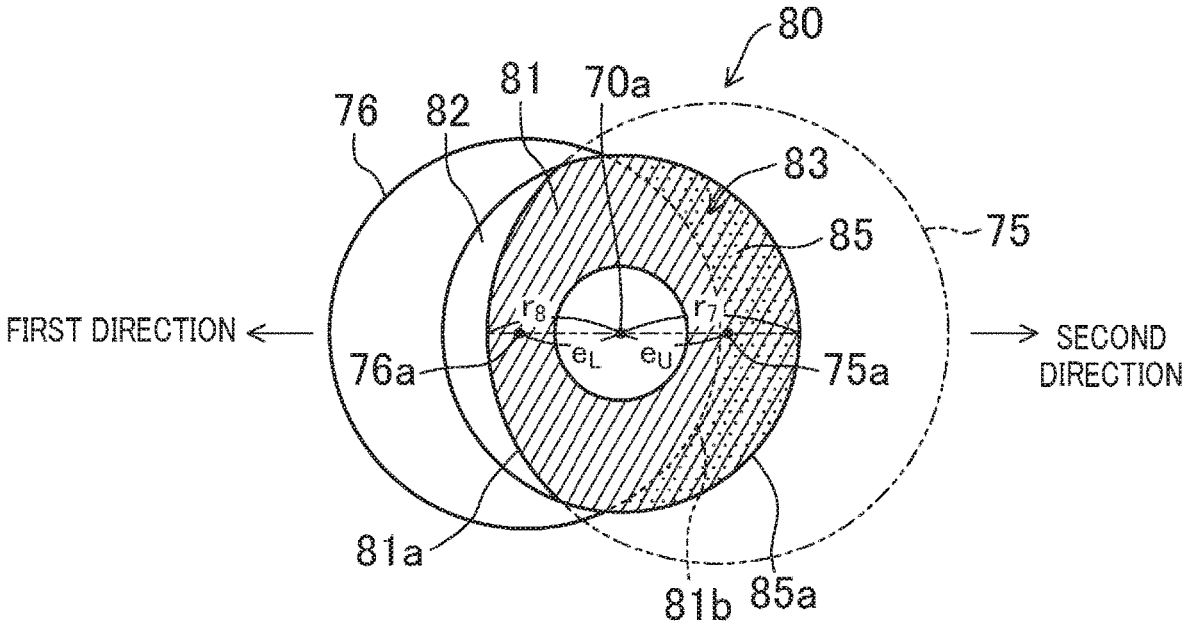
FIG. 14 is a transverse cross-sectional view illustrating a cross section of the drive shaft taken along line G-G in FIG. 7.

As shown in FIG. 13, the outer surface (85*a*) of the large protrusion (85) of the upper intermediate reinforcement portion (83) is configured as a part (arc surface) of the cylindrical surface with its central axis coinciding with the rotational center axis (70*a*) of the drive shaft (70) and with a radius $r_7$. The radius $r_7$ of this arc surface is identical to the radius $r_5$ of the arc surface forming the outer surface (82*a*) of the lower intermediate reinforcement portion (82) ($r_7=r_5$.) As shown in FIG. 7, the radius $r_7$ of the arc surface forming the outer surface (85*a*) of the large protrusion (85) is larger than the minimum distance $r_3$ from the rotational center axis (70*a*) of the drive shaft (70) to the outer peripheral surface of the lower eccentric portion (76) and is smaller than the maximum distance $r_9$ from the rotational center axis (70*a*) of the drive shaft (70) to the outer peripheral surface of the upper eccentric portion (75) ($r_3<r_7<r_9$.)

With this configuration, the upper intermediate reinforcement portion (83) is formed in an area on the second direction side and is formed such that its outer surfaces (84*a*, 85*a*) are positioned inside the outer peripheral surface of the upper eccentric portion (75) and positioned outside the outer peripheral surface of the lower eccentric portion (76) in the radial direction of the drive shaft (70).

As shown in FIG. 7, the height $h_3$ of the upper intermediate reinforcement portion (83) is higher than half the height of the intermediate coupling portion (80) ($h_3>H_{CM}/2$). The height $h_4$ of the small protrusion (84) of the upper intermediate reinforcement portion (83) is lower than the height $h_5$ of the large protrusion (85) ($h_4<h_5$.)

As described above, the heights $h_2$ of the lower intermediate reinforcement portion (82) and $h_3$ of the upper intermediate reinforcement portion (83) are higher than half the height of the intermediate coupling portion (80). That is, the lower intermediate reinforcement portion (82) and the upper intermediate reinforcement portion (83) overlap with each other in the axial direction of the drive shaft (70). As shown in FIGS. 6, 7, and 13, the lower intermediate reinforcement portion (82) and the large protrusion (85) of the upper intermediate reinforcement portion (83) overlap with each other in the axial direction of the drive shaft (70), and an overlapping portion (86) which is a middle part of the intermediate coupling portion (80) has a cylindrical shape axis coaxial with the rotational center axis (70*a*) of the drive shaft (70). Specifically, the outer surface of the overlapping portion (86) is formed of the outer surface (82*a*) of the lower intermediate reinforcement portion (82) and the outer surface (85*a*) of the large protrusion (85) of the upper intermediate reinforcement portion (83), and the cross section of the overlapping portion (86) has a circular shape centered around the rotational center axis (70*a*) of the drive shaft (70). The radius $r_5$ of the arc surface forming the outer surface (82*a*) of the lower intermediate reinforcement portion (82) is identical to the radius $r_7$ of the arc surface forming the outer surface (85*a*) of the large protrusion (85) of the upper intermediate reinforcement portion (83) ($r_5=r_7$.) That is, the overlapping portion (86) has a cylindrical shape with a radius $r_5$ ($=r_7$) and its central axis coincides with the rotational center axis (70*a*) of the drive shaft (70), Detailed Configuration for Inner Peripheral Groove As mentioned above, an inner peripheral groove (48) extending in the circumferential direction is formed in the inner peripheral surface of the lower piston (45). As mentioned above, the inner peripheral groove (48) is formed along an end of the inner peripheral surface of the lower piston (45) in the lower coupling portion (90) side in the axial direction of the drive shaft (70), i.e., along a lower end of the inner peripheral surface of the lower piston (45) and opens toward the lower end of the lower piston (45) in FIG. 16A.

As shown in FIGS. 4 and 5, the inner peripheral groove (48) is formed in a part of the inner peripheral surface of the lower piston (45) in the circumferential direction. Specifically, the inner peripheral groove (48) is formed in the inner peripheral surface of the lower piston (45) within a half circumference of the suction side (suction portion (38) side) from the installation position of the lower blade (46) (i.e., a position where the lower side blade (46) is provided in the circumferential direction of the lower piston (45)). Assuming that an angle of a center line L extending in the extending direction of the lower blade (46) with respect to the central axis (76*a*) of the lower eccentric portion (76) is 0°, the inner peripheral groove (48) is formed from a position A at an angle tilted 30° from the position at this angle (0°) in the rotational direction of the drive shaft (70) as a starting point to a position B at an angle tilted 180° from the position at the angle (0°) in the rotational direction of the drive shaft (70) as an end point in the circumferential direction of the lower piston (45). That is, the inner peripheral groove (48) is formed from the position A at an angle 30° to the position B at an angle 180° in the inner peripheral surface of the lower piston (45).

Further, the inner peripheral groove (48) is formed such that the maximum depth D (the maximum length of the lower piston (45) in the radial direction) is larger than the difference between the radius RS of the auxiliary shaft portion (74) and the distance r3 for the lower eccentric portion (76 ($D>R_S-(R_{eL}-e_L)$)), and the height (the length of the lower piston (45) in the central axis direction) is larger than the difference between the height $H_{PL}$ of the lower piston (45) and the height $H_{CL}$ of the lower coupling portion (90) ($H_{PL}-H_{CL}$.) The inner peripheral groove (48) is formed to have a cross-sectional shape with which a part of the auxiliary shaft portion (74) extending out of the lower eccentric portion (76) as viewed from the axial direction of the drive shaft (70) can be contained inside.

In the rotary compressor (1), by providing an inner peripheral groove (48) in the inner peripheral surface of the lower piston (45) in this manner, a viscous shear loss of a lubricant on the sliding surface between the outer peripheral surface of the lower eccentric portion (76) and the inner peripheral surface of the lower piston (45) is reduced, thereby reducing a friction loss. Further, by forming such an inner peripheral groove (48) at a position of the inner peripheral surface of the lower piston (45) on the suction side at which a load applied by a compressed fluid during operation is relatively small, seizing and abrasion do not occur.

If the inner peripheral groove (48) is formed so as to only reduce friction loss by reducing a viscous shear loss of lubricant, the position at which the inner peripheral groove (48) is formed is not necessary to be the lower end of the inner peripheral surface of the lower piston (45).

However, in the present embodiment, the inner peripheral groove (48) is formed such that the installation position is at the lower end of the inner peripheral surface of the lower piston (45), the maximum depth D and the maximum height H are the above-mentioned values, and the inner peripheral groove (48) has the above-mentioned cross-sectional shape so that the inner peripheral groove (48) can also be used to avoid snagging of the lower piston (45) when the lower piston (45) is attached to the drive shaft (70).

Even if the height $H_{CL}$ of the lower coupling portion (90) is smaller than the height $H_{PL}$ of the lower piston (45), an upper corner of the auxiliary shaft portion on the second direction side enters the inner peripheral groove (48) formed with the above-mentioned size at the above-mentioned position at the time when the lower piston (45) is moved in the radial direction of the drive shaft (70) on the outer periphery of the lower eccentric portion (90) in order to attach the lower piston (45) to the lower eccentric portion (76) from the auxiliary shaft portion (74) side. Thus, the upper corner of the auxiliary shaft portion (74) is not snagged on the inner peripheral surface of the lower piston (45), and the lower piston (45) can be shifted to the position where the lower piston (45) can be fitted to the lower eccentric portion (76). The process of attaching the lower piston will be described in detail below Process of Assembling Compression Mechanism A process of assembling a compression mechanism (15) is now described. When the compression mechanism (15) is assembled, first, the upper plate member (60) and the lower plate member (65) are moved upward in this order from the end of the drive shaft (70) on the auxiliary shaft portion (74) side and are attached to an intermediate coupling portion (80). Thereafter, in the same manner, a lower piston (45) is moved upward from the end of the drive shaft (70) on the auxiliary shaft portion (74) side and is attached to a lower eccentric portion (76). Subsequently, a lower cylinder (35) is disposed below the lower plate member (65), and a rear head (25) is disposed below the lower cylinder (35). Then, an upper piston (40) is moved downward from the end of the drive shaft (70) on the main shaft portion (72) side and is attached to an upper eccentric portion (75). Thereafter, an upper cylinder (30) is disposed above the upper plate member (60), and a front head (20) is disposed above the upper cylinder (30). Then, the front head (20), the upper cylinder (30), the upper plate member (60), the lower plate member (65), the lower cylinder (35), and the rear head (25), which are stacked together, are fastened to each other by a plurality of bolts (not shown).

(Process of Attaching Lower Piston)

A process of attaching a lower piston (45) to a drive shaft (70) is now described below with reference to FIGS. 16A and 16B. When the lower piston (45) is attached to the drive shaft (70), the lower piston (45) is moved from the end of the auxiliary shaft portion (74) of the drive shaft (70) toward the lower eccentric portion (76) in the axial direction of the drive shaft (70).

Figure 16A:
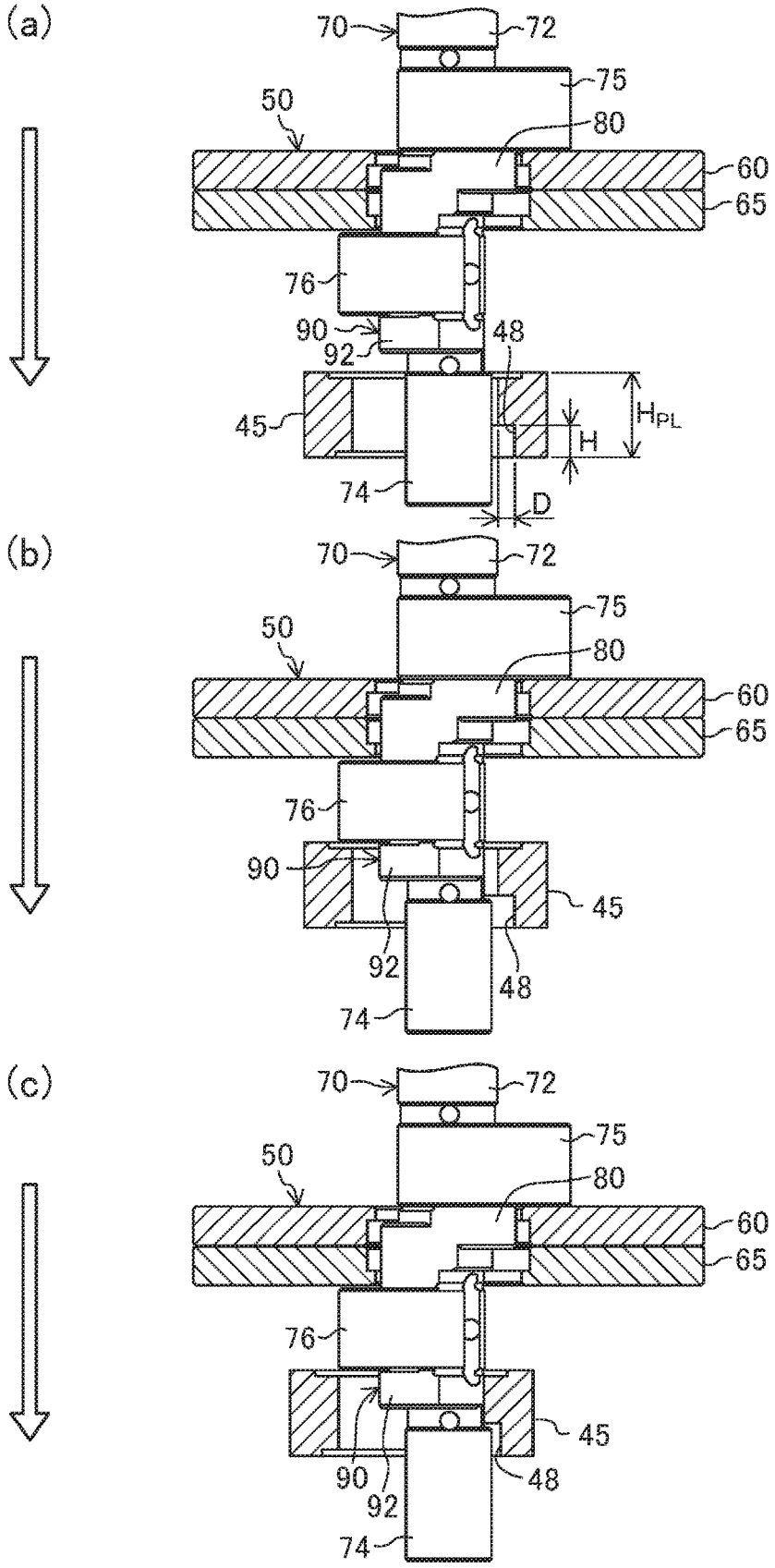
FIG. 16A is a step diagram illustrating steps of attaching a lower piston to a drive shaft.

First, the auxiliary shaft portion (74) of the drive shaft (70) is inserted into the lower piston (45) (see FIG. 16A, (a)), and the lower piston (45) is moved to the position (outer periphery of the lower coupling portion (90)) in contact with lower eccentric portion (76) (see FIG. 16A, (b)). In this state, the upper end of an inner peripheral groove (48) in FIG. 16A of the lower piston (45) is positioned above the upper end of the auxiliary shaft portion (74).

Subsequently, the lower piston (45) is moved to the first direction side (left side in FIG. 16A) which is the eccentric direction of the lower eccentric portion (76) on the outer periphery of the lower coupling portion (90) (see FIG. 16A, (c)). Specifically, on the outer periphery of the lower coupling portion (90), the lower piston (45) is moved to a position where the lower piston (45) can be fitted to the lower eccentric portion (76) (a position where the inner peripheral surface of the lower piston (45) is positioned outside the outer peripheral surface of the lower eccentric portion (76) in the radial direction of the drive shaft (70)).

At this time, the lower piston (45) is rotated such that the inner peripheral groove (48) formed in the inner peripheral surface of the lower piston (45) is positioned on the second direction side (right side in FIG. 16A) which is the direction opposite to the eccentric direction of the lower eccentric portion (76). In this state, the lower piston (45) is moved to the first direction side (the left side in FIG. 16A) which is the eccentric direction of the lower eccentric portion (76). In this manner, since the upper end corner protruding outward compared with the lower coupling portion (90) on the second direction side of the auxiliary shaft portion (74) enters the inner peripheral groove (48) of the lower piston (45). Accordingly, the lower piston (45) can be moved to a position where the lower piston (45) can be fitted to the lower eccentric portion (76) without snagging the upper end corner on the second direction side of the auxiliary shaft portion (74) on the inner peripheral surface of the lower piston (45).

Figure 16B:
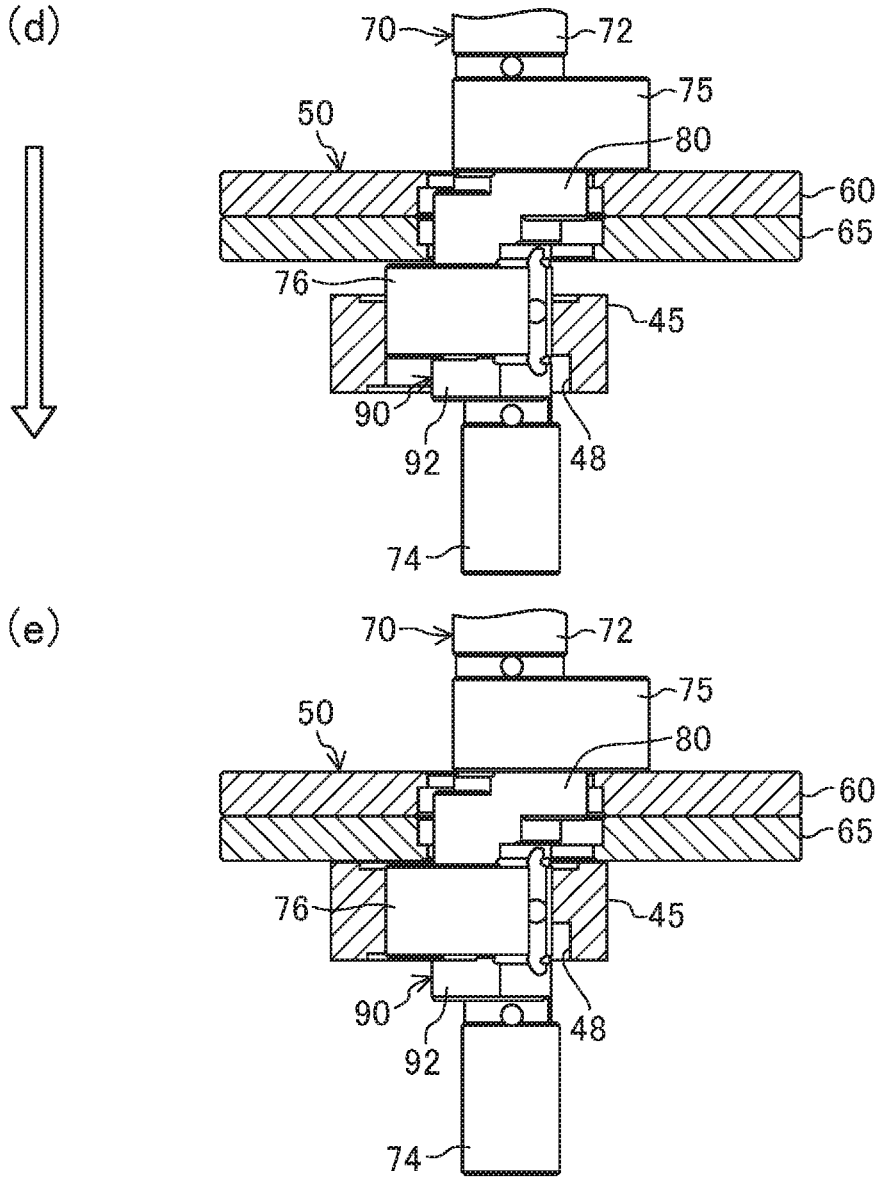
FIG. 16B is a step diagram illustrating steps of attaching a lower piston to a drive shaft.

Then, the lower piston (45) is moved to the lower eccentric portion (76) side in the axial direction of the drive shaft (70) and is fitted to the lower eccentric portion (76) (see FIG. 16B, (d) and (e)). When the lower piston (45) is moved to the position shown in FIG. 16B, (e), the attachment of the lower piston (45) to the drive shaft (70) is finished.

Operation

An operation of the rotary compressor (I) is now described below with reference to FIGS. 1 to 4.

When an electric motor (10) drives a drive shaft (70), the pistons (40, 45) of a compression mechanism (15) are driven by the drive shaft (70), and pistons (40, 45) are moved inside cylinders (30, 35). In the cylinders (30, 35), capacities of a high-pressure chamber and a low-pressure chamber of compression chambers (34, 39) change with movement of the pistons (40, 45). In the cylinders (30, 35), an suction process of sucking a refrigerant from suction ports (33, 38) into compression chambers (34, 39), a compression process of compressing the refrigerant sucked in the compression chambers (34, 39), and a discharge stroke of discharging the compressed refrigerant from the discharge ports (24, 29) to the outside of the compression chambers (34, 39) are performed.

The refrigerant compressed in the compression chamber (34) of the upper cylinder (30) is discharged to the space above the front head (20) through the discharge port (24) of the front head (20). The refrigerant compressed in the compression chamber (39) of the lower cylinder (35) is discharged from the compression chamber (39) through the discharge port (29) of the rear head (25) and flows into the space above the front head (20) through a passage (not shown) formed in the compression mechanism (15). The refrigerant discharged from the compression mechanism (15) to the internal space of the casing (2) flows out to the outside of the casing (2) through a discharge pipe (6).

The bottom portion of the casing (2) stores a lubricant. This lubricant is supplied to the compression mechanism (15) through an oil supply passage (71) formed in the drive shaft (70) and is supplied to a sliding portion of the compression mechanism (15). Specifically, the lubricant is supplied to the space formed between a main bearing (22) and the drive shaft (70) and a space formed between an auxiliary bearing (27) and the drive shaft (70) and spaces formed between the outer peripheral surfaces of the eccentric portions (75, 76) and the inner peripheral surfaces of the pistons (40, 45). The lubricant partially flows into the compression chambers (34, 39) and is used to improve the hermeticity of the compression chambers (34, 39).

The pressure in the internal space of the casing (2) is substantially identical to the pressure of a high-pressure refrigerant discharged from the compression mechanism (15). Thus, the pressure of the lubricant stored in the casing (2) is substantially identical to the pressure of the high-pressure refrigerant discharged from the compression mechanism (15). Accordingly, the high-pressure lubricant is supplied to the compression mechanism (15).

The lubricant supplied to the sliding portion of the compression mechanism (15) partially flows into a middle hole (51) of an intermediate plate (50). The lubricant supplied to the space formed between the outer peripheral surface of the upper eccentric portion (75) and the inner peripheral surface of the upper piston (40) partially flows mainly into this middle hole (51). Therefore, the space formed between the wall surface of the middle hole (51) of the intermediate plate (50) and the outer surface of the intermediate coupling portion (80) of the drive shaft (70) is filled with the high-pressure lubricant. The intermediate coupling portion (80) of the drive shaft (70) is rotated in the middle hole (51) of the intermediate plate (50) filled with the lubricant.

Advantages of First Embodiment

In the first embodiment, the lower eccentric portion (76) is configured such that the length obtained by subtracting the eccentricity $e_U$ of the lower eccentric portion (76) from the radius $R_{eU}$ of the lower eccentric portion (76), i.e., the length from the rotational center axis (70*a*) of the drive shaft (70) to the outer surface of the lower eccentric portion (76) in the second direction (direction opposite to the eccentric direction) (the minimum length $r_3$ from the rotational center axis (70*a*) of the drive shaft (70) to the outer surface of the lower eccentric portion (76)) becomes shorter than the radius $R_M$ of the auxiliary shaft portion (74). That is, in the first embodiment, the lower eccentric portion (76) is configured such that its outer surface on the second direction side (the side opposite to the eccentric side) is recessed in the first direction (toward the eccentric side) with respect to the outer surface of the auxiliary shaft portion (74) on the second direction side (the side opposite to the eccentric side), thereby increasing only the eccentricity without increasing the diameter of the lower eccentric portion (76). With such a configuration, the capacity can be increased without increasing sliding loss of the lower piston (45) on the lower cylinder (35).

With such a condition, in which the outer surface of the drive shaft (70) on the second direction side is recessed toward the eccentric side at the lower eccentric portion (76), when the lower piston (45) is assembled to the lower eccentric portion (76) while being moved from the auxiliary shaft portion (74) side in the axial direction of the drive shaft (70), the lower piston (45) is in contact with the axial end surface of the lower eccentric portion (76) and thus is not moved further in the axial direction, so that the lower piston (45) cannot be attached to the lower eccentric portion (76).

Hence, in the first embodiment, a lower coupling portion (90) is provided between the lower eccentric portion (76) and the auxiliary shaft portion (74) such that its outer surface does not extend out of the outer surface of the lower eccentric portion (76) in the radial direction of the drive shaft (70). By providing such a lower coupling portion (90), a space for shifting the lower piston (45) to a position at which the lower piston (45) can be fitted to the lower eccentric portion (76) when the lower piston (45) is assembled to the lower eccentric portion (76) is secured. That is, in the rotary compressor (1), when the lower piston (45) is moved from the auxiliary shaft portion (74) side in the axial direction of the drive shaft (70) so as to be fitted to the lower eccentric portion (76), the lower piston (45) can be moved on the outer periphery of the lower coupling portion (90) in the radial direction of the drive shaft (70) to the position where the lower piston (45) can be fitted to the lower eccentric portion (76) (position where the inner peripheral surface of the lower piston (45) is positioned outside the outer peripheral surface of the lower eccentric portion (76) in the radial direction of the drive shaft (70)). The lower piston (45) is shifted on the outer periphery of the lower coupling portion (90) in this manner and is then removed in the axial direction of the drive shaft (70), so that the lower piston (45) can be attached to the lower eccentric portion (76). That is, the first embodiment can assemble the lower piston (45) to the lower eccentric portion (76) even when the eccentricity is only increased without increasing the diameter of the lower eccentric portion (76).

When, in the first coupling portion (90) with its outer surface on the second direction side being recessed in the first direction with respect to the outer surface of the auxiliary shaft portion (74) on the second direction side, the outer surface on the first direction side is aligned with the outer surface of the auxiliary shaft portion (74) on the first direction side, the first coupling portion (90) becomes thinner than the auxiliary shaft portion (74). Accordingly, the drive shaft (70) is necked down at the first coupling portion (90) and is easily warped.

Hence, in the first embodiment, the first coupling portion (90) is provided with the reinforcement portion (92) with its outside surface positioned outside the outer surface of the auxiliary shaft portion (74) in the radial direction of the drive shaft (70). Accordingly, since the first coupling portion (90) is formed to be thick by the reinforcement portion (92), the warpage of the drive shaft (70) can be substantially prevented even when the first coupling portion (90) is formed such that its outer surface on the second direction side is recessed in the first direction with respect to the outer surface of the auxiliary shaft portion (74) on the second direction side.

In first embodiment, a first intermediate reinforcement portion (82) with its outer surface positioned inside the outer surface of the first eccentric portion (76) and positioned outside the outer surface of the second eccentric portion (75) is provided adjacent to the first eccentric portion (76) in an area of the intermediate coupling portion (80) coupling the first eccentric portion (76) with the second eccentric portion (75) on the first direction side. By providing such a first intermediate reinforcement portion (82), a part of the intermediate coupling portion (80) on the first eccentric portion (76) side between the first eccentric portion (76) and the second eccentric portion (75) that eccentrically rotate can be formed to be thick. Accordingly, the warpage of the drive shaft can be substantially prevented.

In the first embodiment, a second intermediate reinforcement portion (83) with its outer surface positioned inside the outer surface of the second eccentric portion (75) and positioned outside the outer surface of the first eccentric portion (76) is provided adjacent to the second eccentric portion (75) in an area of the intermediate coupling portion (80) coupling the first eccentric portion (76) with the second eccentric portion (75) on the second direction side. By providing such a second intermediate reinforcement portion (83), a part of the intermediate coupling portion (80) on the second eccentric portion (75) side between the first eccentric portion (76) and the second eccentric portion (75) that eccentrically rotate can be formed to be thick. Accordingly, the warpage of the drive shaft can be substantially further prevented.

In the first embodiment, in the intermediate coupling portion 80), the first intermediate reinforcement portion (82) and the second intermediate reinforcement portion (83) overlap with each other in the axial direction of the drive shaft (70), and the overlapping portion (86) which is a middle part of the intermediate coupling portion (80) has a cylindrical shape coaxial with the rotational center axis (70*a*) of the drive shaft (70). By forming the overlapping portion (86) which is a portion where the first intermediate reinforcement portion (82) and the second intermediate reinforcement portion (83) overlap with each other in a middle area of the intermediate coupling portion (80) in the axial direction into a cylindrical shape, the middle part of the intermediate coupling portion (80) in the axial direction can be formed to be thick. Accordingly, the warpage of the drive shaft can be substantially further prevented.

In a multi-cylinder rotary compressor including a plurality of eccentric portions, when eccentric portions with increased eccentricity without increasing the diameters are provided on a side of the main shaft portion coupled with an electric motor and has a large diameter than an auxiliary shaft portion in a drive shaft, a piston cannot be configured to be fitted to the eccentric portions without notching the outer surface of a portion adjacent to the eccentric portions of the main shaft portion on a side opposite to the eccentric side as in a conventional rotary compressor. Although the main shaft portion coupled with an electric motor in the drive shaft is required to have large strength, the diameter of a part of the main shaft portion adjacent to the eccentric portions becomes small with such a configuration, and warpage of the drive shaft may become large.

In the first embodiment, the lower eccentric portion (76) with increased eccentricity without increasing the diameter is provided not on the main shaft portion (72) side having a larger diameter, coupled to the electric motor (10) of the drive shaft (70), but on the auxiliary shaft portion (74) side having a smaller diameter than the main shaft portion (72). Thus, in order to configure the lower piston (45) to be fitted to the lower eccentric portion (76), the lower coupling portion (90) with its outer surface on the second direction side being recessed in the first direction is coupled with not the main shaft portion (72) having a large diameter, but the auxiliary shaft portion (74) having a small diameter. Accordingly, an increase in warpage of the drive shaft (70) can be substantially prevented without decreasing the strength of the main shaft portion (72) that is coupled with the electric motor (10) and is required to have large strength in the drive shaft (70).

In the first embodiment, the lower eccentric portion (76) has a small diameter than the upper eccentric portion (75). With this configuration, the intermediate plate (50) can be easily attached between the lower cylinder (35) and the upper cylinder (30) without increasing the diameter of the middle hole (51) of the intermediate plate (50) by attaching the intermediate plate (50) between the lower cylinder (35) and the upper cylinder (30) through the outer periphery of the lower eccentric portion (76) having a smaller diameter from the auxiliary shaft portion (74) side of the drive shaft (70).

In the first embodiment, the drive shaft (70) is configured such that the minimum distance $r_8$ from the rotational center axis (70*a*) of the drive shaft (70) to the outer peripheral surface of the upper eccentric portion (75) becomes the radius $R_M$ of the main shaft portion (72) or more ($r_8=R_{eU}-e_U \geq R_M$). That is, the drive shaft (70) is configured such that its outer surface of the drive shaft (70) is not recessed toward the eccentric side at the upper eccentric portion (75). Therefore, when the lower piston (45) and the upper piston (40) are assembled to the lower eccentric portion (76) and the upper eccentric portion (75), respectively the lower piston (45) allows the drive shaft (70) to be inserted from the auxiliary shaft portion (74) side, and the upper piston (40) allows the drive shaft (70) to be inserted from the main shaft portion (72) side. Accordingly, the upper piston (40) can be assembled directly to the upper eccentric portion (75) without causing the upper piston (40) to across the lower eccentric portion (76). Therefore, the first embodiment can improve the ease of assembly.

Other Embodiments

The above-described embodiments may be modified as follows.

In the first embodiment, the first coupling portion is formed between the auxiliary shaft portion (74) and the lower eccentric portion (76), and the drive shaft (70) is configured so as to satisfy $R_{eL}-e_L<R_S$. However, the first coupling portion according to the present invention may be formed between the main shaft portion (72) and the upper eccentric portion (75), and the drive shaft (70) may be configured so as to satisfy $R_{eU}-e_U<R_M$.

Specifically, in the first embodiment, the lower cylinder (35) is configured as the first cylinder, the lower piston (45) is configured as the first piston, the lower eccentric portion (76) is configured as the first eccentric portion, the auxiliary shaft portion (74) is configured as a first shaft portion, the upper cylinder (30) is configured as the second cylinder, the upper piston (40) is configured as the second piston, the upper eccentric portion (75) is configured as the second eccentric portion, the main shaft portion (72) is configured as the second shaft portion, the radius $R_{eL}$ of the lower eccentric portion (76) represents the radius of the first eccentric portion, the radius $R_S$ of the auxiliary shaft portion (74) represents the radius $R_1$ of the first shaft portion, the eccentricity et, of the lower eccentric portion (76) represents the eccentricity of the first eccentric portion, and the first coupling portion is formed between the auxiliary shaft portion (74) and the lower eccentric portion (76), and the drive shaft (70) is configured so as to satisfy $R_{eL}-e_L<R_S$. However, the upper cylinder (30) may be configured as the first cylinder, the upper piston (40) may be configured as the first piston, the upper eccentric portion (75) may be configured as the first eccentric portion, the main shaft portion (72) may be configured as a first shaft portion, the lower cylinder (35) may be configured as the second cylinder, the lower piston (45) may be configured as the second piston, the lower eccentric portion (76) may be configured as the second eccentric portion, the auxiliary shaft portion (74) may be configured as the second shaft portion, the radius $R_{eU}$ of the upper eccentric portion (75) represents the radius Re of the first eccentric portion, the radius $R_M$ of the main shaft portion (72) represents the radius $R_1$ of the first shaft portion, the eccentricity $e_U$ of the upper eccentric portion (75) represents the eccentricity $e_1$ of the first eccentric portion, and the first coupling portion may be formed between the main shaft portion (72) and the upper eccentric portion (75), and the drive shaft (70) may be configured so as to satisfy $R_{eU}-e_U<R_M$.

Alternatively, as in the first embodiment, the first coupling portion according to the present invention may be formed between the auxiliary shaft portion (74) and the lower eccentric portion (76) and between the main shaft portion (72) and the upper eccentric portion (75), and the drive shaft (70) may be configured so as to satisfy $R_{eL}-e_L<R_S$ and $R_{eU}-e_U<R_M$.

In the first embodiment, the auxiliary shaft portion (74) has a smaller diameter than the main shaft portion (72)

($2R_S<2R_M$). However, the auxiliary shaft portion (74) may have a substantially the same diameter as the main shaft portion (72) $2R_S=2R_M$).

In the first embodiment, the compression mechanism (15) is configured as a so-called two-cylinder compression mechanism having the upper cylinder (30) and the lower cylinder (35). However, the compression mechanism (15) may be a single-cylinder compression mechanism having only the lower cylinder (35).

Further, in the first embodiment, the intermediate plate (50) includes the upper plate member (60) and the lower plate member (65). However, the intermediate plate (50) may include a single plate member or three or more plate members.

In the first embodiment, the rotary compressor (1) is configured as a so-called swinging-piston rotary compressor. The rotary compressor (1) according to the present invention is required to be a rotary compressor and is not necessary to be a swinging-piston rotary compressor. For example, the rotary compressor (1) may be a rolling-piston rotary compressor.

Further, the rotary compressor (1) according to the present invention may be a swinging-piston rotary compressor in which blades (41, 46) are formed separately from pistons (40, 45), Specifically, the rotary compressor (1) may be an swinging-piston rotary compressor in which a pair of bushes (42, 47) are not included, blades (41, 46) separated from the pistons (40, 45) are supported by the respective blade grooves formed in cylinders (30, 35) so as to freely move back and forth, and the outer peripheral surfaces of the pistons (40, 45) have recesses in which the ends of the blades (41, 46) are fitted and are configured such that the pistons (40, 45) are in sliding contact with the ends formed of the cylindrical surfaces of the blades (41, 46) to be fitted in the recesses and oscillate along with rotation of the drive shaft (70).

As can be seen from the foregoing description, the present invention is useful as a rotary compressor that sucks and compresses a fluid.

What is claimed is:

1. A rotary compressor comprising:

a first cylinder;

a first piston that has a cylindrical shape, the first piston being configured to revolve along an inner wall surface of the first cylinder, and the first piston forming a first compression chamber configured to compress a fluid between the first piston and the inner wall surface of the first cylinder; and a drive shaft that is rotatable, the drive shaft including:

a first eccentric portion that is eccentric in a first direction with respect to a rotational center axis and to which the first piston is fitted, a first shaft portion that is rotatably supported by a first bearing formed on an end plate to close one end face of the first cylinder, and the first shaft portion having a cylindrical shape coaxial with the rotational center axis of the drive shaft, a second shaft portion that is provided on a side opposite to the first shaft portion of the first eccentric portion in an axial direction, to which an electric motor that drives the drive shaft to rotate is coupled, and that has a cylindrical shape coaxial with the rotational center of the drive shaft, and a first coupling portion that is formed radially within the end plate, when viewed in a direction perpendicular to the rotational center axis, and that couples the first shaft portion with the first eccentric portion, the first shaft portion having a smaller diameter than the second shaft portion, the drive shaft being configured to satisfy the following mathematical expression: $R_{e1}-e_1<R_1$, wherein $R_{e1}$ is a radius of the first eccentric portion, $R_1$ is a radius of the first shaft portion, and $e_1$ is an eccentricity of the first eccentric portion, and the first coupling portion being formed such that an outer surface thereof does not extend out of an outer surface of the first eccentric portion in a radial direction of the drive shaft, and the first coupling portion including a reinforcement portion with an outer surface thereof positioned outside an outer surface of the first shaft portion in the radial direction of the drive shaft.

2. The rotary compressor of claim 1, further comprising:

a second cylinder; and a second piston that has a cylindrical shape, the second piston being configured to revolve along an inner wall surface of the second cylinder, and the second piston forming a second compression chamber configured to compress a fluid between the second piston and the inner wall surface of the second cylinder, a drive shaft that is rotatable, the drive shaft including a second eccentric portion that is provided on a side opposite to the first coupling portion of the first eccentric portion in an axial direction, and the second eccentric portion being eccentric in a second direction opposite to the first direction with respect to the rotational center axis and to which the second piston is fitted, and an intermediate coupling portion that couples the first eccentric portion with the second eccentric portion, and the intermediate coupling portion including a first intermediate reinforcement portion that is formed in an area on the first direction side, disposed adjacent to the first eccentric portion, and the intermediate coupling portion having an outer surface positioned inside the outer surface of the first eccentric portion and positioned outside an outer surface of the second eccentric portion in the radial direction of the drive shaft.

3. The rotary compressor of claim 2, wherein the intermediate coupling portion further includes a second intermediate reinforcement portion that is formed in an area on the second direction side, disposed adjacent to the second eccentric portion, and the intermediate coupling portion has an outer surface positioned inside the outer surface of the second eccentric portion and positioned outside the outer surface of the first eccentric portion in the radial direction of the drive shaft.

4. The rotary compressor of claim 3, wherein in the intermediate coupling portion, the first intermediate reinforcement portion and the second intermediate reinforcement portion overlap with each other in the axial direction of the drive shaft, and at least a part of the portion where the first intermediate reinforcement portion and the second intermediate reinforcement portion overlap with each other in the intermediate coupling portion in the axial direction of the drive shaft has a cylindrical shape coaxial with the rotational center axis of the drive shaft.

5. The rotary compressor of claim 2, wherein a second shaft portion continuously extends from a side of the second eccentric portion opposite to the intermediate coupling portion in the axial direction, and the second shaft portion is rotationally supported by a second bearing formed on another end plate to close one end face of the second cylinder.

6. The rotary compressor of claim 5, further comprising:

an intermediate end plate that has a middle hole to allow the drive shaft to pass therethrough, that blocks other ends of the first cylinder and the second cylinder between the first cylinder and the second cylinder, and that is in sliding contact with other ends of the first piston and the second piston, the first eccentric portion having a smaller diameter than the second eccentric portion.

7. The rotary compressor of claim 5, wherein the drive shaft is configured to satisfy the following mathematical expression: $R_{e2}-e_2 \geq R_2$, wherein $R_{e2}$ is a radius of the second eccentric portion, $R_2$ is a radius of the second shaft portion, and $e_2$ is an eccentricity of the second eccentric portion.

* * * * *